US012324957B2

(12) United States Patent
Sakhrani et al.

(10) Patent No.: US 12,324,957 B2
(45) Date of Patent: Jun. 10, 2025

(54) HEAD PRESSURE-RESISTANT DEVICE FOR NECK EXERCISES

(71) Applicants: Andrew Sakhrani, Dollard-des-Ormeaux (CA); Neil Rohr, Côte-Saint-Luc (CA)

(72) Inventors: Andrew Sakhrani, Dollard-des-Ormeaux (CA); Neil Rohr, Côte-Saint-Luc (CA)

( * ) Notice: Subject to any disclaimer, the term of this patent is extended or adjusted under 35 U.S.C. 154(b) by 110 days.

(21) Appl. No.: 18/021,116

(22) PCT Filed: Aug. 13, 2021

(86) PCT No.: PCT/CA2021/000064

§ 371 (c)(1),
(2) Date: Feb. 13, 2023

(87) PCT Pub. No.: WO2022/032372

PCT Pub. Date: Feb. 17, 2022

(65) Prior Publication Data

US 2023/0310931 A1 Oct. 5, 2023

Related U.S. Application Data

(60) Provisional application No. 63/065,303, filed on Aug. 13, 2020.

(51) Int. Cl.
*A63B 23/025* (2006.01)
*A63B 21/02* (2006.01)

(52) U.S. Cl.
CPC ..... *A63B 23/025* (2013.01); *A63B 21/02* (2013.01); *A63B 21/023* (2013.01); *A63B 21/028* (2013.01)

(58) Field of Classification Search
CPC ..... A63B 23/025; A63B 21/02; A63B 21/023; A63B 21/028; A63B 21/00; A63B 21/065
See application file for complete search history.

(56) References Cited

U.S. PATENT DOCUMENTS

| | | | | |
|---|---|---|---|---|
| 2017/0049655 | A1* | 2/2017 | Sung | A63B 23/025 |
| 2020/0324163 | A1* | 10/2020 | Berry | A63B 71/0619 |
| 2022/0379164 | A1* | 12/2022 | Dickenson | A63B 21/4045 |
| 2023/0148095 | A1* | 5/2023 | Aref | A63B 21/4019 482/121 |

* cited by examiner

*Primary Examiner* — Andrew S Lo
(74) *Attorney, Agent, or Firm* — PRAXIS

(57) ABSTRACT

A device for neck exercises comprising a base, a resistance assembly, and a movable body. The base defines a surface engaging side and an opposite inner side. The resistance assembly comprises at least one resistance element comprising flexible and resilient material. The resistance assembly is mounted to the inner side of the base and defines a height thereof. The movable body is movably mounted to the base for reciprocally moving towards and away the base. The movable body defines a user engaging surface for being engaged by the head of a user and an opposite inner side for engaging the resistance assembly. Pressure by the head of a user against the user engaging surface imparts a movement to the movable body towards the base providing for engagement of the movable body inner side against the resistance assembly to decrease the height thereof. The resistance assembly provides resistance against the movement of the movable body.

20 Claims, 20 Drawing Sheets

HEAD PRESSURE-RESISTANT DEVICE FOR NECK EXERCISES

CROSS-REFERENCE TO RELATED APPLICATIONS

The present application claims priority on U.S. Provisional Application Ser. No. 63/065,303 filed on Aug. 13, 2020, and incorporated herein in its entirety.

TECHNICAL FIELD

The present disclosure generally relates to an exercise device. More particularly, but not exclusively, the present disclosure relates to a head pressure-resistant device for neck exercises.

BACKGROUND

Musculoskeletal disorders are very common and often due to incorrect sitting in chairs and incorrect standing which is related to non-specific neck pain. Louw et al. (2017) noted non-specific neck pain is a common health problem of global concern especially in office workers. Neck pain is classified as non-specific when the pathophysiology is relatively unknown or unclear. This means that the person who has the neck pain is not aware of it or unobservant of the factors associated with neck pain to seek guidance from a clinical professional. The pain is not because of any underlying pathology or systemic disease; the symptoms are localized to the neck region (Louw et al., 2017). The neck region is comprised of many different muscles and bones. Specifically, when discussing the neck, it is meant to think of the cervical spine from C1-C7. The cervical spine region is a weak part of the skeletal region that is normally not strengthened due to a lack on concepts or equipment available to provide over to people who suffer from chronic neck pain.

The average office worker sits in front of a desk for eight hours per day facing a computer that is below eye level. The average smartphone user looks down at their phone seven hours per day. The average person also looks down and flexes their neck cervical spinal muscles twelve hours unknowingly over the course of a day. When someone is involved in a motor vehicle accident (MVA) and suffers a mild traumatic brain injury (Mtbi) the post-concussion symptom resulting from the accident can trigger different responses that can affect the musculoskeletal system. All these factors have one common aspect and that is how they are all associated with neck pain. One such musculoskeletal disorder that is also associated with diseases and unhealthy behaviors is neck pain. Genebra et al. (2017) noted neck pain is one of the major musculoskeletal disorders in the adult population and its prevalence in the world economy ranges from 16.7%-75.1%. The condition of neck pain has several risk factors associated with human health such as ergonomic (strenuous physical activity, use of force and vibration, inadequate posture, repetitive movement), individual (age, body mass index (BMI), musculoskeletal pain history), behavioral (smoking and level of physical activity), and psychological (job satisfaction, stress level, anxiety, and depression) (Genebra et al., 2017). Due to the incidence of these current issues in society, it is critical to provide knowledgeable and understandable information to the public regarding ways to adjust their health and to optimize the health of people who suffer from neck pain in any regard.

Office workers and non-office workers are most prone to neck pain and are constantly reporting neck pain and/or tenderness as their reason for lost productivity and lost time at work. Louw et al. (2017) noted the most common reason for work absenteeism among office workers is because of pain or tenderness in the neck region, inhibiting working abilities. Computer workers are two to three times more likely to develop chronic neck pain when compared to the general public (Louw et al., 2017). Due to this insight, the prior research by Louw et al. (2017) demonstrates the association between neck pain and absenteeism in the work environment for office and non-office workers.

Athletes are another group of individuals who experience neck pain due to the constant force and velocity, weight, and fatigue placed on their bodies. Noormohammadpour et al. (2018) noted athletes spend more time in sports activities, and they experience higher mechanical loads on their cervical spine. Such musculoskeletal stress can accumulate over years of participation in sports from adolescence to adulthood, depending on the type, intensity, frequency, and duration of sports (Noorrnohammadpour et al., 2018). Most of the time, neck pain is brought upon by minor injuries that eventually affect larger surrounding muscles. Durall (2012) noted athletic neck pain is the result of minor injuries, such as ligament sprains, muscle strains or soft tissue contusions. Data on the prevalence of benign neck pain in athletes are lacking, presumable because surveillance efforts in this population have focused on serious cervical spine injuries (Durall, 2012). Regardless of the origin of symptoms, athletes with neck pain may have deficits in muscle recruitment, strength and endurance, repositioning acuity, postural stability, or oculomotor control (Durall, 2012).

OBJECTS

An object of the present disclosure is to provide a device for neck exercises.

An object of the present disclosure is to provide a kit for neck exercises.

SUMMARY

In accordance with an aspect of the present disclosure, there is provided a device for neck exercises comprising: a base defining a surface engaging side and an opposite inner side; a resistance assembly comprising at least one resistance element comprising flexible and resilient material, the resistance assembly mounted to the inner side of the base and defining a height thereof; and wherein pressure by the head of a user against the user engaging surface imparts a movement to the movable body towards the base providing for engagement of the movable body inner side against the resistance assembly to decrease the height thereof, the resistance element providing resistance against the movement of the movable body.

In an embodiment, the resistance assembly comprises a rigid structure providing the height of the resistance assembly, the rigid structure being movably mounted to the base member and the inner side of the movable body and being movable towards the base member during the movement of the movable body towards the base thereby decreasing the height of the resistance assembly, the resistance element being operatively connected to the rigid structure to resist the movement of the rigid structure towards the base member. In an embodiment, the rigid structure comprises a pair of arms pivotally mounted at top end thereof to the movable body inner side and at pivotally mounted at a bottom end thereof to the base member, the bottom ends of the pair of arms being movable along a length of the base member, wherein the resistance element is mounted to the bottom ends of the pair of arms to resist the movement thereof along the a length of the base member. In an embodiment, the resistance element comprises a U-shaped configuration having a central portion thereof mounted to the base member and free ends thereof mounted to the bottom ends of the pair of arms.

In an embodiment, the movable body is pivotally mounted to the base member and wherein the movable body is movable from an open position to a closed position engaging the base member. In an embodiment, the movable body and the base member comprises mutual locking elements for being locked in the closed position.

In an embodiment, the device comprises additional resistance elements comprising respective levels of resistance thereby providing for selective modulation of the resistance against the movement of the movable body.

In an embodiment, the resistance assembly comprises at least one receiving structure for receiving the at least one resistance element therein, wherein the receiving structure is mounted to the base member, the movable member inner side engaging the at least one resistance element directly, the at least one resistance element providing the height of the resistance assembly. In an embodiment, the receiving structure is selected from the group consisting of a socket, a pocket, and a combination thereof.

In an embodiment, the device further comprises additional resistance elements comprising respective levels of resistance thereby providing for selective modulation of the resistance against the movement of the movable body.

In embodiment, the device further comprises additional resistance elements comprising respective heights thereof respectively providing for the resistance assembly height.

In an embodiment, the device further comprises at least one additional resistance element being coupled to the at least one resistance element in order to increase the height thereof.

In an embodiment, the additional resistance elements are removably mounted to a portion of the base not engaged by the movable member inner side when not in use.

In an embodiment, the movable body is slidably connected to the base member. In an embodiment, the movable body and the base comprise mutually slidably engaging lateral sides extending between the user engaging surface and the surface engaging side. In an embodiment, the device further comprises one or more biasing elements mounted to the base inner side and engaging the movable body inner side for biasing the movable body away from the base.

In an embodiment, the movable body is pivotally mounted to the base member.

In an embodiment, the surface engaging side provides for being mounted to a surface.

In an embodiment, the device further comprises a supporting structure, the surface engaging side being mountable to the supporting structure.

In accordance with an aspect of the present disclosure, there is provided a kit for neck exercises comprising at least one of the devices herein and instructions for use thereof.

The device provides for the user to push with their head against the movable body, the movement being resisted by a resistance assembly comprising at least one resistance element interposed between the movable body and the base so that the movable body directly pushes against the resistance assembly, decreasing its height via pressure. In an embodiment, the resistance assembly comprises a movable rigid structure interposed between the movable body and the base member to pushed towards the base member by the movement of the main body. The rigid structure provides the resistance assembly height, and its downward movement causes the decrease in height. The resistance element is connected to the rigid stricture to resist this downward movement. In an embodiment, the resistance assembly comprises a receiving structure mounted to the base member with the resistance element mounted thereto. In this embodiment, the resistance element provides the height of the resistance assembly and the movable body engages the resistance element directly. The resistance element thus resists this decrease in height and movement of the movable body. The foregoing resistance allows the neck exercise (i.e. head movement against the movable body) to be performed against the resistance of the resistance assembly.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated and in accordance with an aspect of the present disclosure, there is provided a device for neck exercises comprising a base, a resistance assembly and a movable body. The base defines a surface engaging side and an opposite inner side. The resistance assembly comprises at least resistance element comprises flexible and resilient material. The resistance assembly is mounted to the inner side of the base and defines a height thereof. The movable body is movably mounted to the base for reciprocally moving towards and away from the base. The movable body defines a user engaging surface for being engaged by the head of a user and an opposite inner side for engaging the resistance element. Pressure by the head of a user against the user engaging surface imparts a movement to the movable body towards the base providing for engagement of the movable body inner side against the resistance assembly to decrease the height thereof. The resistance assembly provides resistance against the movement of the movable body. The foregoing provides the user to perform neck exercises by pushing their head against the movable body.

With reference to FIGS. 1 to 11, there is shown an exercise device 10 used in neck therapeutic exercises. The device 10 provides a resistance pressure against which the user performs the exercises. The device 10 is mounted to a surface such as a wall, floor, a door jam, a support column, and the like and as will be further explained below.

Device 10 defines a user engaging side 12 and an opposite surface mounting side 14 with a contour wall 16 therebetween.

Figure 10:
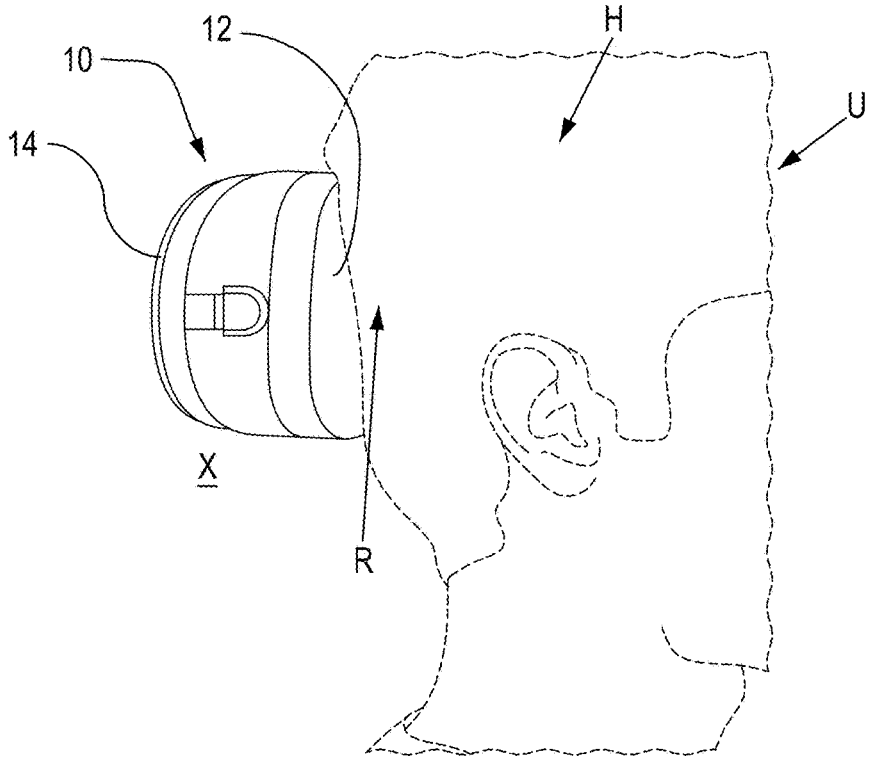
FIG. 10 is a lateral perspective view of the device of FIG. 1 mounted to a vertical surface and in use in accordance with a non-restrictive illustrative embodiment of the present disclosure.
Figure 11:
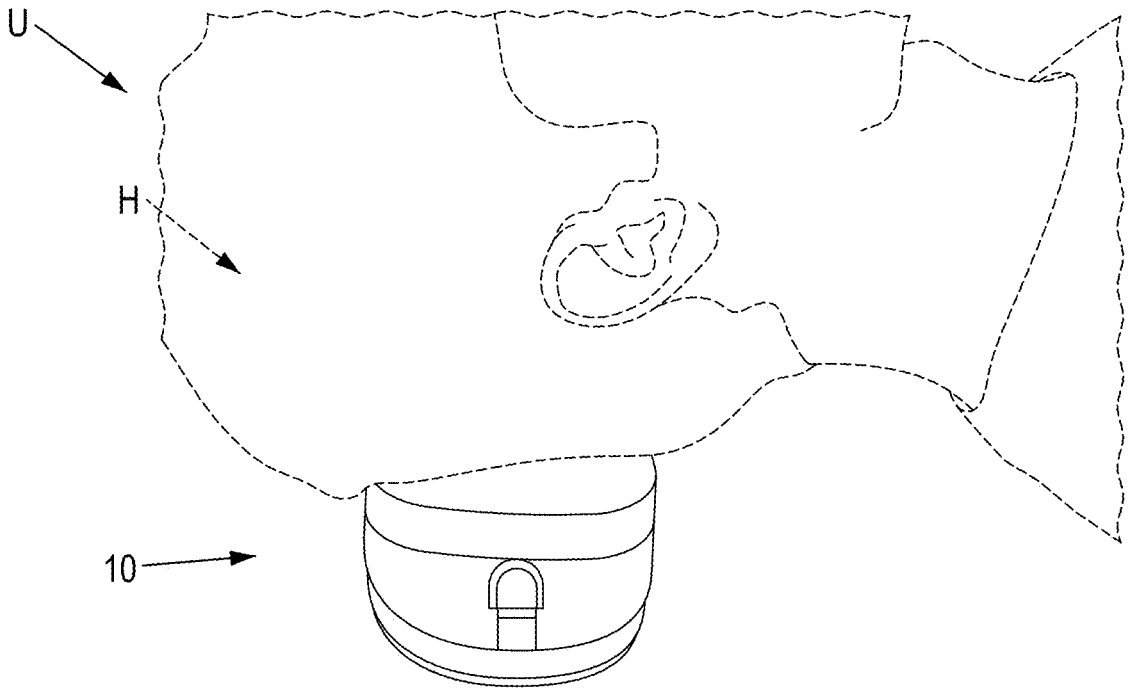
FIG. 11 is a lateral perspective view of the device of FIG. 1 mounted to a horizontal surface and in use in accordance with a non-restrictive illustrative embodiment of the present disclosure.

In an embodiment, the user engaging side 12 is made of a deformable, flexible and resilient material such as soft foam providing comfort when in use. As shown in FIGS. 10 and 11, side 12 provides a bed on which the user U engages their head H in order to provide for neck movement exercises as will be further described herein. In an embodiment, the user engages the rear and mid to lower part of their head H and specifically the mid and lower parietal portion and occipital portion of the skull in order to provide for the neck movement exercises. In an embodiment, the user engages the side part of their head H such as the parietal and/or temporal portions of the skull. In an embodiment, the user engages the front part of their head, such as frontal portion of the skull. As such, the engaging side 12 provides a subtlety concave configuration for better engagement of the rear part of the head.

The surface engaging side 14 includes mounting elements 18 in the form of adhesive pads. In an embodiment, the adhesive pads 18 comprise removable adhesive material allowing users to mount, remove and remount the device 10 on a surface multiple times. In another embodiment, the mounting elements 18 are provided by suction cups. In another embodiment, the mounting elements 18 are fasteners. The skilled artisan will readily appreciate that the device 10 may be mounted to a surface in a variety of ways within the scope of the present disclosure. The surface engaging side 14 includes a central recessed cut-out portion 20 flanked by a pair of short legs 22A and 22B carrying respective mounting elements 18 thereon. The cut-out portion 20 provides for fitting the device 10 over a door stop or on an additional device element as will be further discussed below.

Turning now to FIGS. 4, 5, 8, 7 and 8, the components of the device 10 include a shell assembly 24 comprising a movable body or member 26 and a base such as a base body or base member 28. A cover 29 in the form of a pad (for example) defines the engaging side 12 and is mounted to the movable body 26. The shell assembly 24 defines the contour wall 16. The base body 28 defines the surface engaging side 14. The cover 29 and movable body 26 define a movable platform 30 that is movable relative to the base body 28.

The base body 28 comprises an oblong configuration with an open face 32 opposite the surface engaging side 14 and defining a peripheral edge 34 which delimits the base contour wall 35.

The base body 28 is a shell with a base floor 36 and includes a main compartment 38 extending from the floor 30 for receiving a resistance element 40 therein in the form or a circular resistance pad. The main compartment and the resistance element form part of a resistance assembly.

The resistance element 40 comprises flexible and resilient material that is deformable against pressure but with a degree of resistance in order to resiliently gain its shape against this pressure. A variety of suitable materials can thus be contemplated by the skilled artisan within the scope of the present disclosure. Indeed, the resistance element 40 defines a height thereof that is decreased when placed under pressure and the resistance element provides for resisting this decrease in height.

Figure 4:
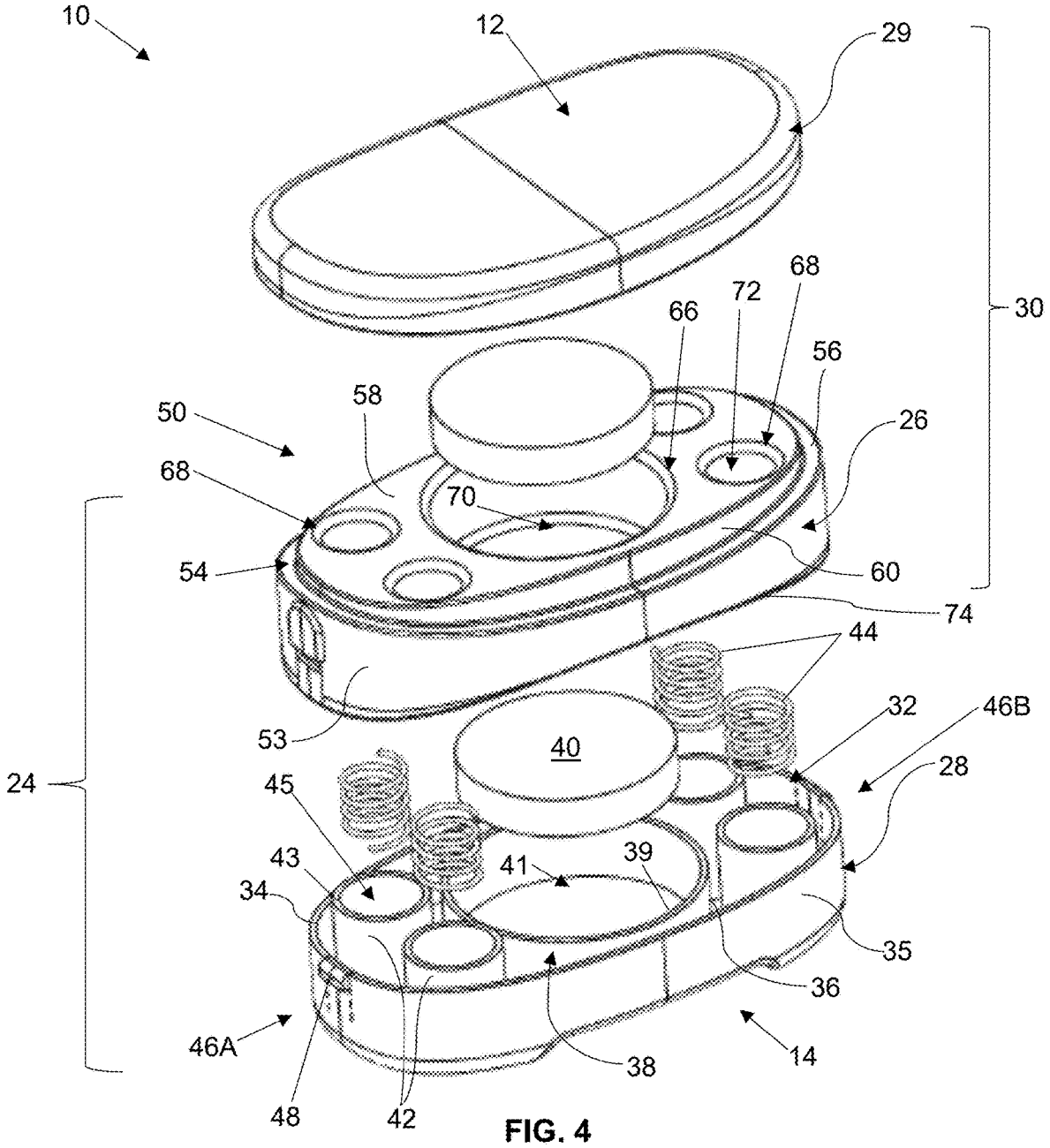
FIGS. 4, 5, 6, 7, and 8 are exploded perspective view of the device of FIG. 1.

The main compartment 38 is in the form of a circular open structure defining a rim 39 and cavity 41 for receiving the resistance element 40 therein. Of course, more than on main compartment for receiving more than one resistance element can be contemplated within the scope of the present disclosure. The main compartment 38 is surrounded by additional auxiliary compartments 42. In this example, there are four auxiliary compartments, of course, a greater or lesser number of auxiliary compartments can be contemplated within the scope of the present disclosure. Each auxiliary compartment 42 provides for receiving a respective biasing element 44. The auxiliary compartments 42 are circular structures defining a rim 43 and cavity 45 for receiving the biasing element 44 therein. In FIG. 4, the biasing elements 44 are shown to be tension or resistance springs whereas in FIGS. 5 and 6 the biasing elements are shown to be cylindrical biasing pads. The auxiliary compartments and the biasing elements form part of a resistance assembly.

The lateral sides 46A and 46B of the base body 28 include connecting elements 48 in the form of short snap tabs.

The movable body 26 is a shell including front and rear side 50 and 52 respectively and a contour wall 53. When assembled, walls 35 and 53 define the contour wall 16 of the shell assembly 24. The front side 50 defines a peripheral recessed portion 54 which provides for a peripheral shoulder 56 circumscribing a main protruding surface 58 defining a short lateral wall 60.

Figure 6:
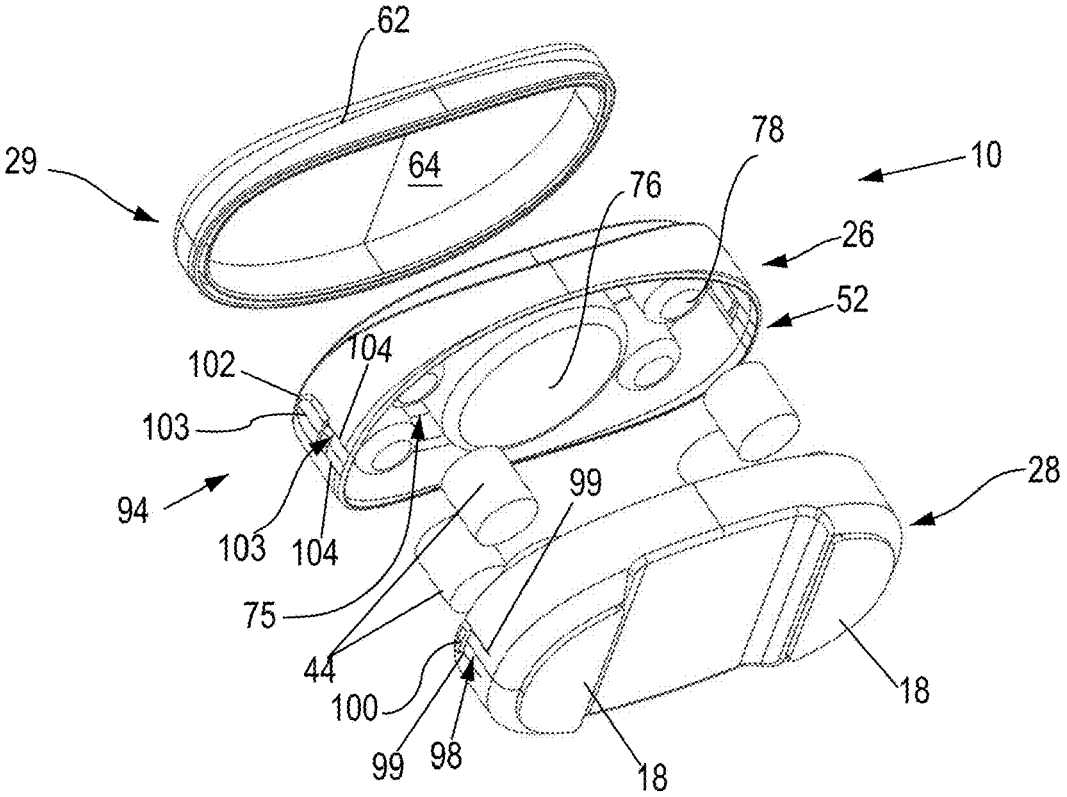
Figure 7:
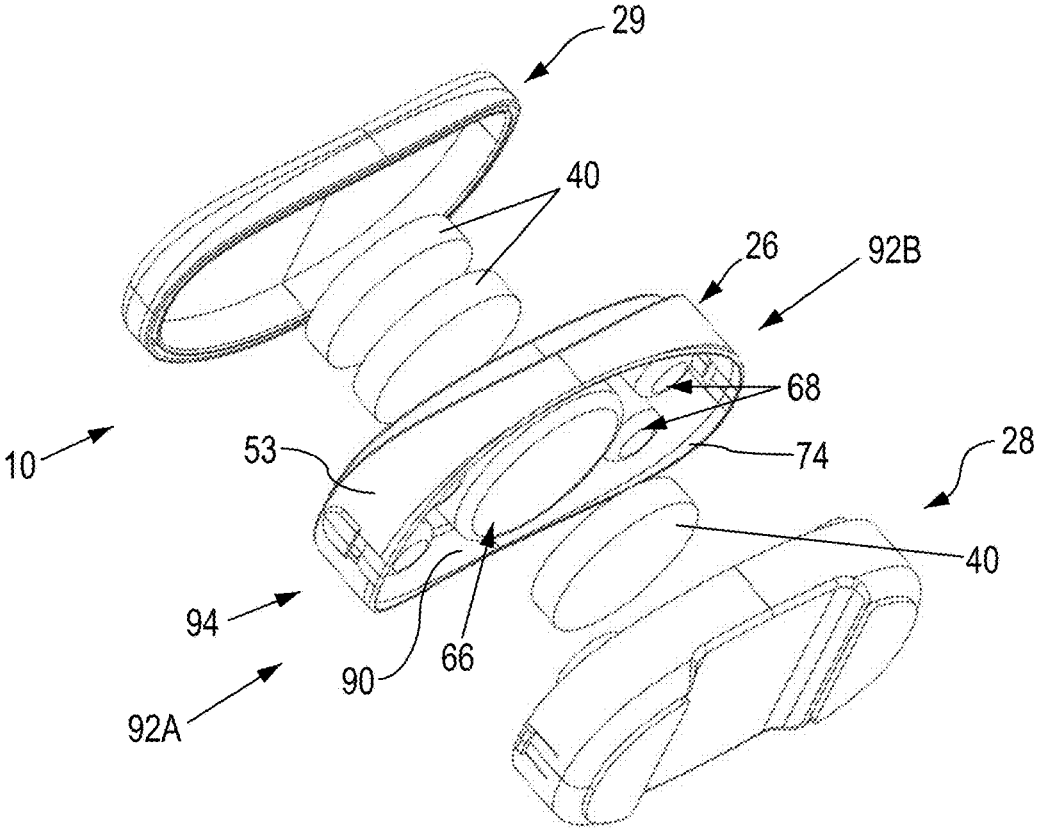
Figure 9:
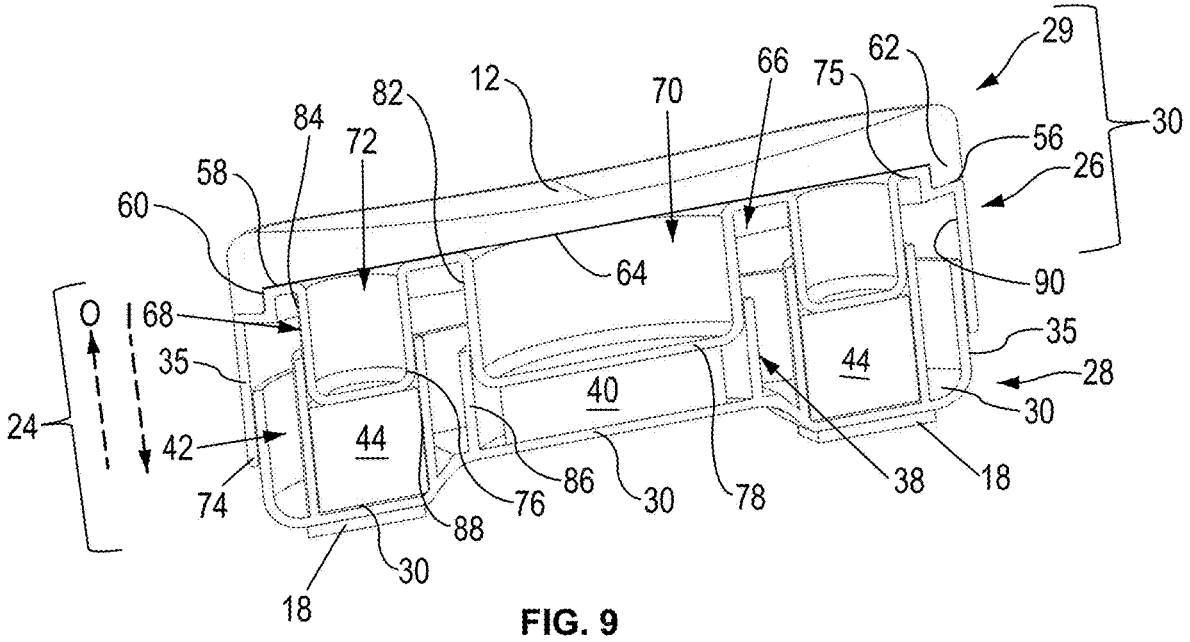
FIG. 9 is a sectional view of the device of FIG. 1.

The cover 29 grips the lateral wall 60 and engages the shoulder 56 when mounted thereto. The front side 50 has a subtlety concave configuration cover 29. With reference to FIGS. 6, 7 and 9 the cover 29 forms a skirt 62 downwardly extending from the user engaging side 12 which peripherally borders a recessed inner side 64. As shown in FIG. 9, the skirt 62 sits on shoulder 56 gripping wall 60 as the inner side 64 overlays the surface 58.

The front side 50 of the movable body 26 includes a main container 66 and the auxiliary container 68 defining respective cavities 70 and 72 with respective rims 71 and 73 that are flush with the surface 58. The rear side 52 is an open face circumscribed by the contour wall 53 which defines a rim 74 being the mouth of the open face 52. The front side 50 defines an opposite undersurface 75 with the cup like bodies of the main container 66 and auxiliary containers 68 extending therefrom and terminating at respective bottom walls 76 and 78.

As better shown in FIG. 9, the main container 66 is similarly configured and co-aligned with the main compartment 38 yet smaller in size to be fitted therein. Each of the auxiliary containers 68 is also similarly configured and co-aligned with a respective one of the auxiliary compartments 42 yet smaller in size to be fitted therein. As the main compartment 38 contains a resistance pad 40 therein, the bottom wall 76 of the main container 66 engages the resistance pad 40 and as such is only partially fitted therein. Accordingly, pad 40 is positioned within the main compartment 38 and sandwiched between the bottom wall 76 of the main container 66 and the floor 30 of the base body. Each of the auxiliary compartments 42 includes a respective biasing element 44 positioned therein, thus when the movable body 26 and the base body 28 are assembled, the bottom wall 78 of each auxiliary container 68 engages a respective biasing element 44 allowing for only partial entry of the containers 68 within the compartments 42. Indeed, the biasing elements 44 are sandwiched between the bottom walls 78 of the movable body 26 and the floor 30 of the base body 28.

Functionally, the cup-like containers 66 and 68 of the movable body 26 form protrusions with respective outer lateral walls 82 and 84 whereas the compartments 38 and 42 of the base body 28 form sleeves with respective inner lateral walls 86 and 88 for respectively receiving these protrusions therein allowing the protrusions to reciprocally move inwardly (as shown by arrow I in FIG. 9) and outwardly (as shown by arrow O) thereof which provides for the complementary movement of the movable body 26 and thus the movable platform with respect to the base body 28. Moreover during movements I and O, wall 82 of the main container protrusion 66 slides along inner wall 86 of the main compartment sleeve 38 in tandem with walls 84 of the auxiliary container protrusions 68 sliding along respective inner walls 88 of the auxiliary compartment sleeves. The inward movement I is dampened or resisted by the resistance pad 40 as well as by the biasing elements 44 which act against bottom walls 76 and 78. Indeed the biasing elements 44 bias the movable body 26 towards the outward direction O.

The rear side open face 52 of the movable body 26 receives therein the face 32 of the base body 28. In this way, the inner side 90 of the contour wall 53 of the movable body 26 slidably engages the outer side of the contour wall 35 of the base body 28 to slidably move thereon as shown by arrows I and O in FIG. 9.

The lateral sides 92A and 92B of the oblong shaped movable body 26 include connecting elements 94 for being mutually connected to the connecting elements 48 of the base body 28.

Figure 5:
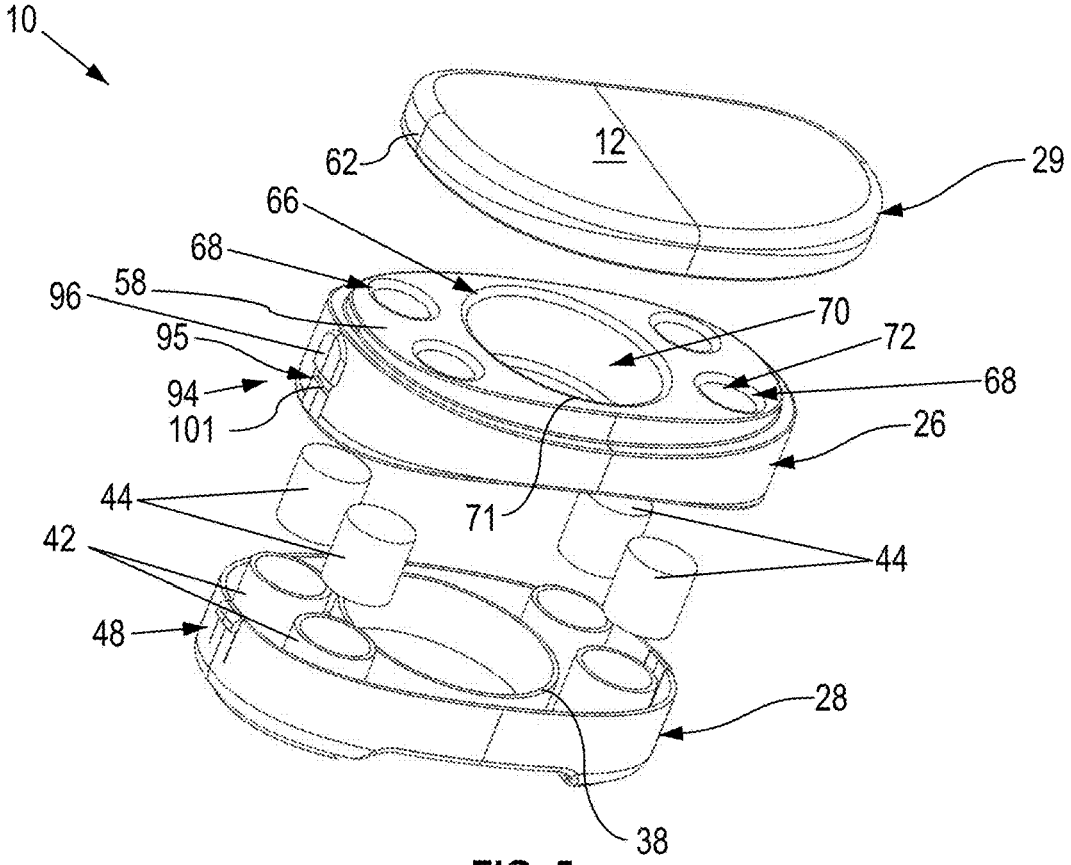

With particular reference to FIGS. 5 and 6, the connecting elements 94 and 48 will be further described. Connecting elements 94 include respective openings 95 with adjacent sockets 96. Connecting elements 48 are in the form of snap tabs as previously mentioned including a spring part 98 formed by slits 99 within wall 35, the spring part 98 carrying a top ridge 100. Thus, when fitting the movable body 26 to the base body 28, the inner side 90 (of the contour wall 53 belonging to the movable body 26) slides along the wall 34 of the base body 28 and thereby interferingly pushing the ridge 100 and the spring part 98 inwardly, the ridge 100 lunges out when it meets the opening 95. The ridge 100 acts as a hook releasably clinging to a lower edge 101 defined by the opening 95. In this way, the movable body 26 is assembled to the base body 28. During inward movement, the sockets 96 slide over the ridges 100 thereby receiving the ridges 100 therein to maintain assembly between bodies 26 and 28 of the shell 24 and thus allowing the movable body 26 to move. Inwards movement is ultimately stopped by the closed end 102 of the socket engaging the ridge 100. During outward movement, the sockets 96 slide over the ridges until the ridges 100 are exposed and engaged by the lower edge 101 thus stopping further outward movement. The lower edge 101 forms part of a spring part 103 provided by slits 104 on the wall 35 of the base body 28. In this way, the spring parts 98 and 103 provide flexibility to the connecting elements 94 and 48 respectively in order to allow the mutual engagement connection and the inward and outwards movement described herein.

Of course, other mutually connecting elements to movably and removably connect the movable body 26 to the base body 28 in order to allow for the inward and outward movement described herein.

Figure 8:
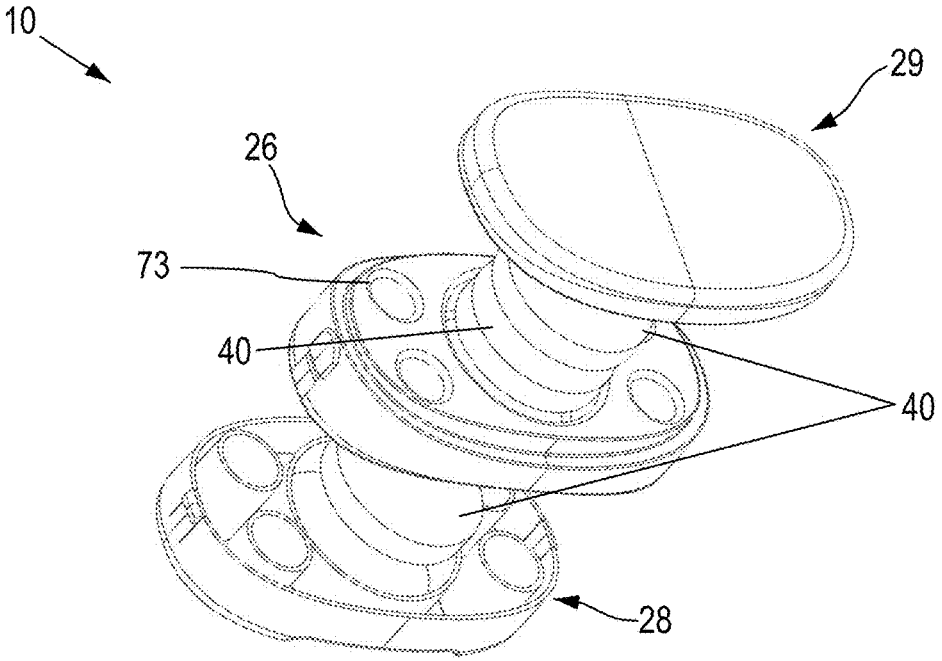

As shown in FIGS. 7 and 8, the device 10 may house one or a plurality of resistance pads 44 which are configured to provide greater or lesser degrees of resistance against pushing by the bottom wall 76 during inward movement I. The resistance pads 44 may be provided in various indicative colours or include indicia to indicate lesser or greater resistance. Thus, the resistance pad 40 being used to resist inward movement I from the bottom wall 78 is positioned within the main compartment 38. The non-used resistance pads 44 can positioned within the main container 66 which is shown being deeper for holding a plurality of pads 40. In another embodiment, the main compartment 38 can be configured to include one or more stacked pads 40 to modulate the level of resistance.

The biasing elements 44 are positioned within the auxiliary compartments 42 and exert a biasing force against the bottom walls 78 to push the movable body 26 to move outwardly in the direction O. Additional biasing elements can be positioned within the auxiliary containers 68 when not in use. The biasing elements can provide different levels (greater or lesser) of biasing forces which indeed increases or decreases the resistance against the bottom walls 78 during inward movement I. The elements 44 can also be provided within indicia such as colours to differentiate between biasing force levels. Moreover, elements 44 can be stacked within the compartments 42 in a variety of or permutations to modulate the biasing force. Thus, both the pads 40 and the elements 44 can modulate the resistance level related to pushing the movable platform 30 as well as the reciprocal biasing force (in the O direction) against this push force (in the I direction).

With reference to FIGS. 10 and 11 the device 10 will now be described in operation. As shown the user U places the surface mountable side 14 on a vertical surface Y such as a wall as shown in FIG. 10 or on a horizontal surface X such as a floor as shown in FIG. 11. The user U then engages the surface engaging side 12 with the rear part R of their head in order to push the movable platform 30 inwardly I towards the base body 28 and against the resistance of resistance imparter such as elements 40 and/or the biasing elements 44 as described herein. The movable platform 30 is biased away from the movable body 28 this moving in the outward direction O when pressure on the user engaging side 12 is released or diminished. This allows the user to perform exercises by moving their neck in order to push the device 10 inwardly I.

In an embodiment, the exercise simulates the "chin tuck" exercise that has the user contract the cervical spine area from C4-C7 with a tempo of 2-3 seconds for the eccentric (lengthening of muscle) and concentric (shortening of muscle). The user is not flexing the spinal cord back, they are meant to pull their head back in a specific way to simulate pushing their neck backwards to isolate the cervical spine.

In another embodiment, the user places the side of their head H on the surface engaging side 12 for pushing the movable platform inwardly against the resistance. The foregoing exercise works on lateral flexion of the neck. With this motion, the user also has a consistent tempo of 2-3 seconds between the eccentric and concentric motion.

When the user places the back of their head H on the device 10, the muscles of the neck and surrounding area that are engaged are: deep cervical flexors, lower cervical extensors, scalene muscles along the front sides of the neck, upper thoracic muscles of the shoulder, and suboccipital muscles at the base of the skull.

When the user places the side of their head H on the device 10, the muscles of the neck and surrounding area that are engaged are: scalenes and the stemocleidomastoid.

Posture and positioning of the neck are essential for proper use of the device 10, muscle engagement, and optimal results. Poor posture in the upper body leads to rounded shoulder position (RSP) and a forward head position (FHP). When using the device 10 is in both the back or side of the head, the user must be cognizant in rolling the shoulders back to improve their posture. Furthermore, the user needs to also make sure that they are simply not trying to flex the spinal cord as this can cause injury over time. The user must use the motion in a way to isolate the neck and tuck their chin inwards (chin tuck) to focus on the specific area while pushing their head back with ease and not to much force.

Device 10 provides the user to perform neck exercises in a consistent resistance for the user to apply to their daily life instead of using body weight. The "chin tuck" is commonly prescribed for neck pain and to treat poor neck alignment, although the chin tuck is performed using only body weight. Due to this, one person may do the chin tuck different from someone else based on the way the exercise is done and the pressure/resistance applied.

Device 10 is simply placed on a wall, floor in any location and placed at a certain height for the user to do the exercise and when done, take it off the wall or floor and put it in a carrying case.

Poor posture is currently seen as a healthcare epidemic due to the use of technology and jobs that institute sedentary lifestyles such as office jobs. Due to the incidence of poor posture in society, the rising cost of healthcare insurance has amounted to half a trillion dollars of spending for neck pain annually in North America and over 45 trillion dollars of spending globally. When someone suffers from neck pain, this can lead to a wide array of issues and factors that can predispose someone to further musculoskeletal issues in the body. Neck pain primarily affects the region of the cervical spine (neck) from C4-C7. When this occurs, this can lead to muscle weakness, nerve damage, degenerative discs, arthritis, whiplash, concussion risks, and skeletal damage. The "chin tuck" is commonly seen as the gold standard exercise for neck strengthening. Furthermore, it has been recommended by manual healthcare practitioners (athletic therapists, physiotherapists, osteopaths, and massage therapists) to work on the side of the neck to strengthen the stemocleidomastoid to avoid injury and weakness of the neck region. Due to the incidence of neck pain in an object of the devices of the disclosure in accordance with a non-limiting illustrative embodiment is to provide a resistance exercise tool to work on neck alignment and poor posture.

In the context of neck pain, there are three musculoskeletal disorders that must be taken into account. Osteoporosis is a musculoskeletal disorder that relates to compression fractures on the spine. Osteoporosis can lead to neck pain due to a poor spinal structure which leads to nerve impingement. The nerve impingement is caused by a lack of muscle and bone mineral density. Atrophy is a condition caused by a lack of muscle around the surrounding areas. Atrophy and neck pain are related as there are limited muscles that are around the neck to support the cervical spine. When someone has weak muscles around the neck, this can further affect posture, and as well lead to pain in the upper back which initially starts in the neck. Scoliosis is a curvature of the spine, and it is not directly associated with neck pain. Scoliosis can be linked to an abnormal curve of the spine in the thoracic region, but when the curve moves towards the neck, this can lead to degeneration and slipped discs. The negative affects of this can lead to surgeries and a poor alignment of the neck.

Treating atrophy, osteoporosis, and scoliosis from the start with exercise therapy can provide a way to effectively prevent musculoskeletal disorders from occurring. Furthermore, by lowering the incidence of possible musculoskeletal disorders from taking place, this may lead to less time spent on surgeries and manual therapy for treating neck pain.

In an embodiment, the devices herein are a strengthening tool to prevent the onset of these musculoskeletal disorders from occurring by building muscle around the area to support the cervical spine.

Figure 12:
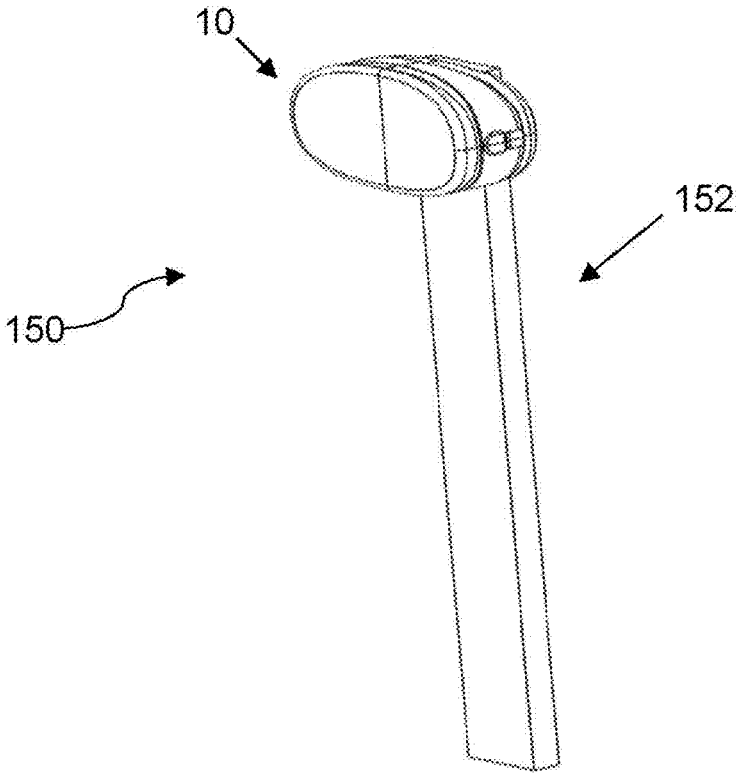
FIG. 12 is a perspective view of a chair mountable pressure device for neck exercising comprising the device of FIGS. 1-11 in accordance with a non-restrictive illustrative embodiment of the present disclosure.
Figure 13:
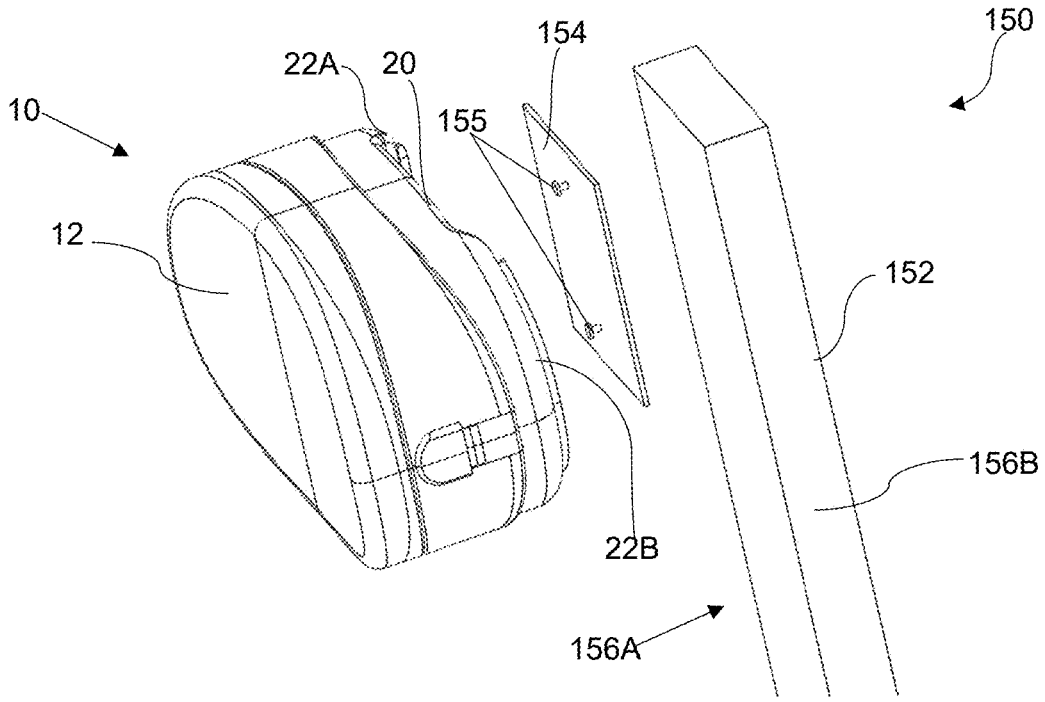
FIG. 13 is an exploded perspective view of the device of FIG. 12.
Figure 14:
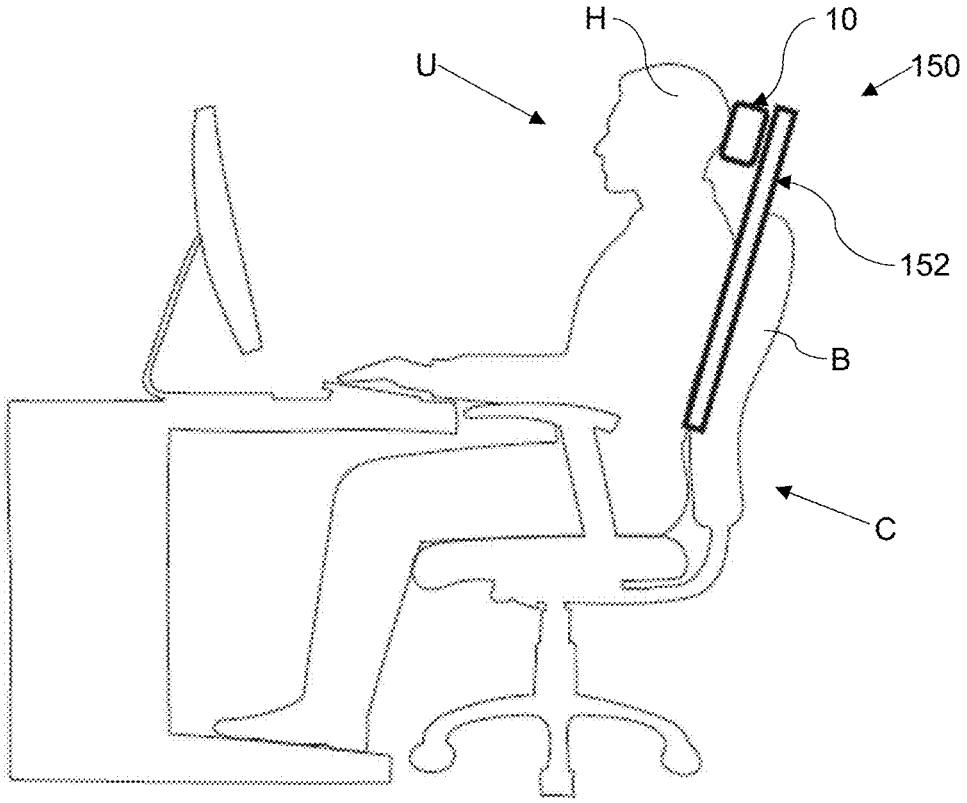
FIG. 14 is a schematic lateral side view of the device of FIG. 12 mounted to a chair and in use in accordance with a non-restrictive illustrative embodiment of the present disclosure.

Turning now to FIGS. 12 to 14, there is shown an exercise device 150 used in neck therapeutic exercises as provided herein. Device 150 comprises device 10 mounted to a support 152. The support 152 comprises a longitudinal member, and the device 10 is mounted thereto at the surface mounting side 14 thereof. More particularly, a connecting panel 154 is fastened (via fasteners 155) to the cut-out portion 20 of side 12 and also fastened to the support 152 with the short legs 22A and 22B flanking each side 156A and 156B of the support 152.

A user U can mount the support 152 against the backrest B their chair C and thus use the device 150 as shown in FIG. 14 with the head H of the user U engaging the user engaging side 12 while seated.

With reference to FIGS. 15 to 23, there is shown an exercise device 200 used in neck therapeutic exercises as provided herein. The device 200 provides a resistance pressure against which the user performs the exercises. The device 200 is mounted to a surface such as a wall, floor, a door jam, a support column, and the like and as will be further explained below.

Device 200 comprises a movable member or body 202 pivotally mounted to a base member or body 204 via a shaft 206 positioned therebetween. The movable member 202 defines a user engaging side 208 and an opposite inner side 210. The base member 204 defines a surface engaging side 212 and an opposite inner side 214. Installation arms 216A and 216B are pivotally mounted to the shaft 206.

Figure 15:
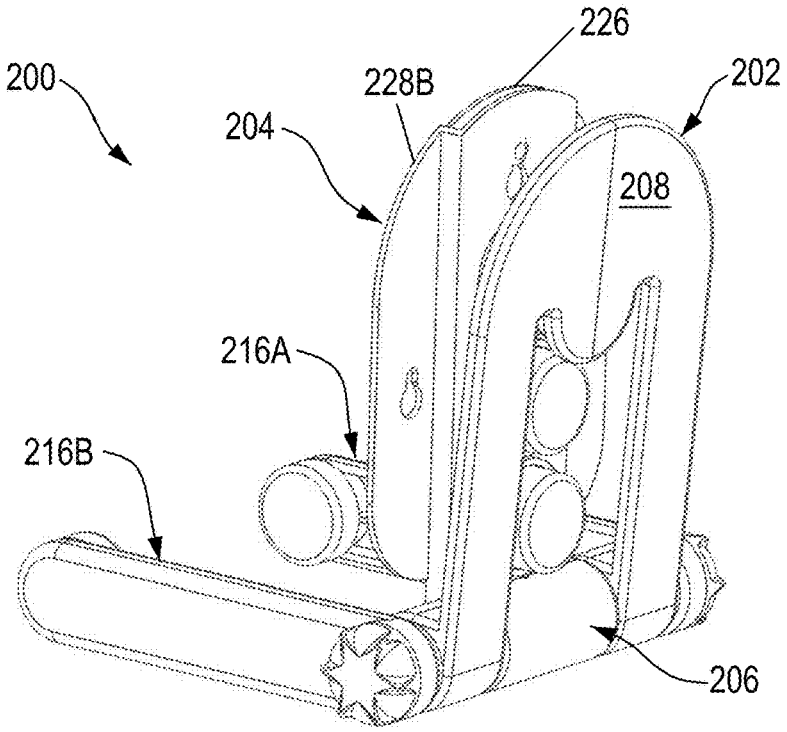
FIG. 15 is a first lateral and front side perspective view of a head pressure-resistant device for neck exercises in accordance with another non-restrictive illustrative embodiment of the present disclosure.
Figure 16:
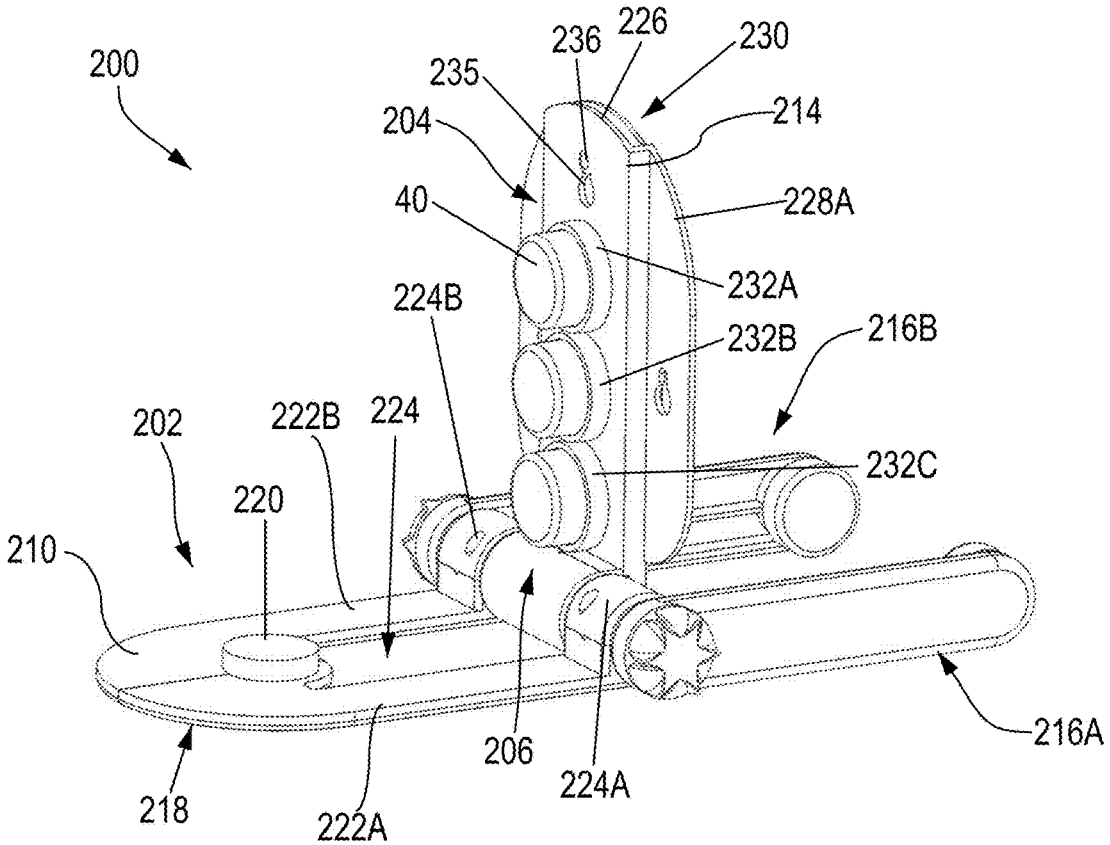
FIG. 16 is a second lateral and front side perspective view of the device of FIG. 15.
Figure 17:
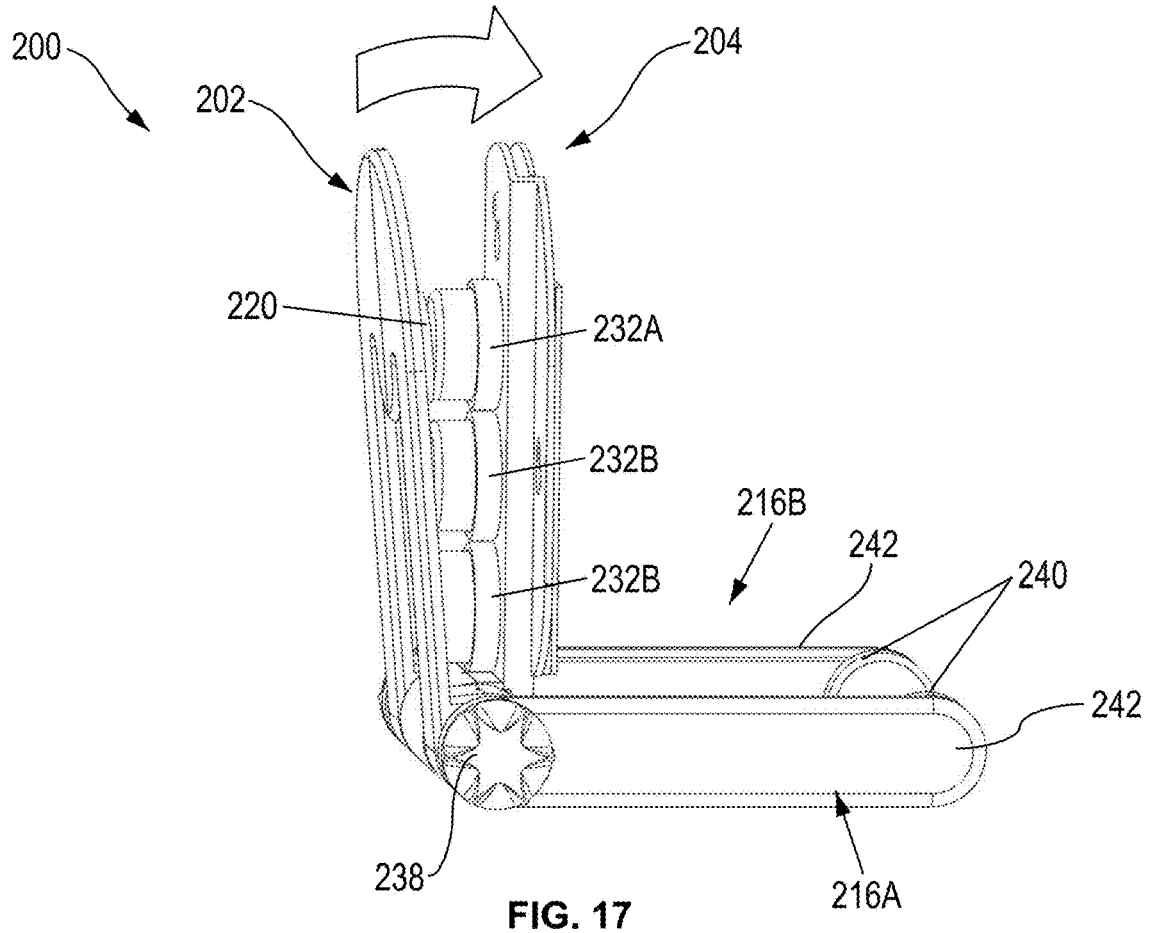
FIG. 17 is a side view of the device of FIG. 15.

The movable member 202 comprises top plate 218 with a protrusion 220 extending from its inner side 210. A pair of spaced apart legs 222A and 222B extend from the top plate and form clamps 224A and 224B at their opposite terminal ends which are pivotally mounted to the shaft 206 to provide the movable member 202 to pivot about the shaft 206 towards and away from the base member 204 as shown in FIGS. 15 and 16 for example. The spaced apart legs 222A and 222B define a space 224 therebetween.

Figure 18:
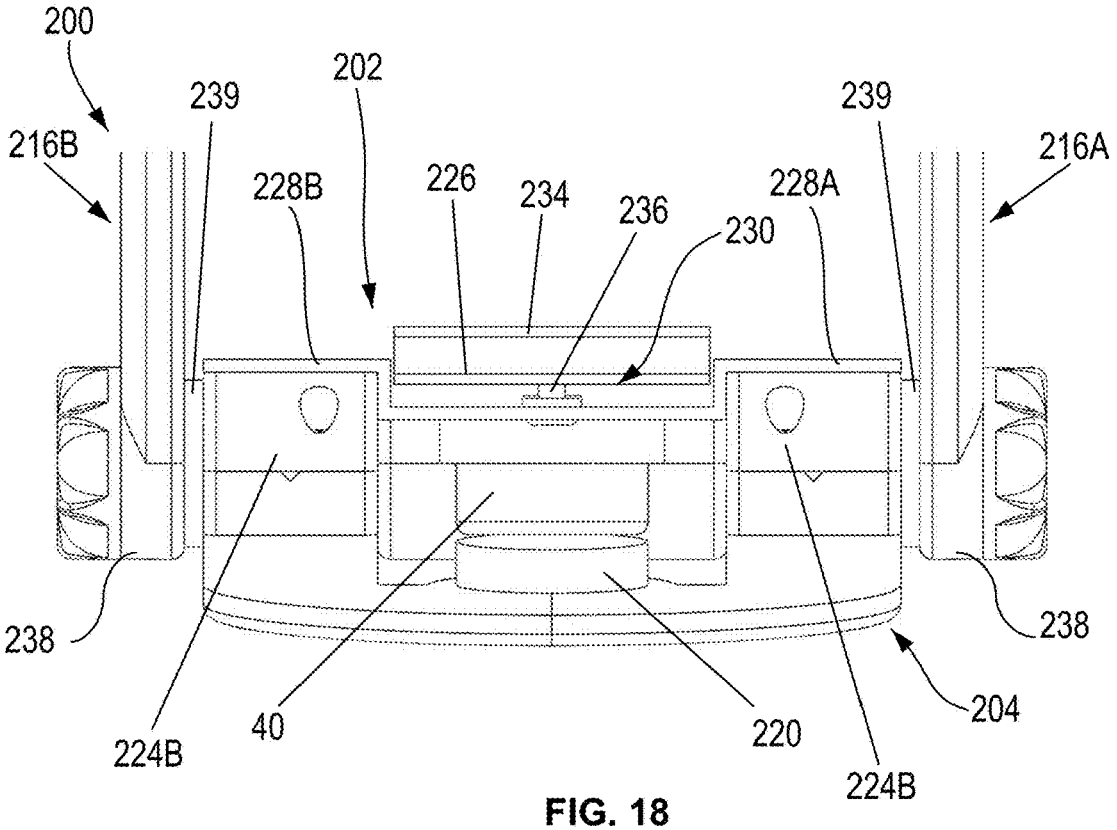
FIG. 18 is a top plan view of the device of FIG. 15 during an exercise position.
Figure 22:
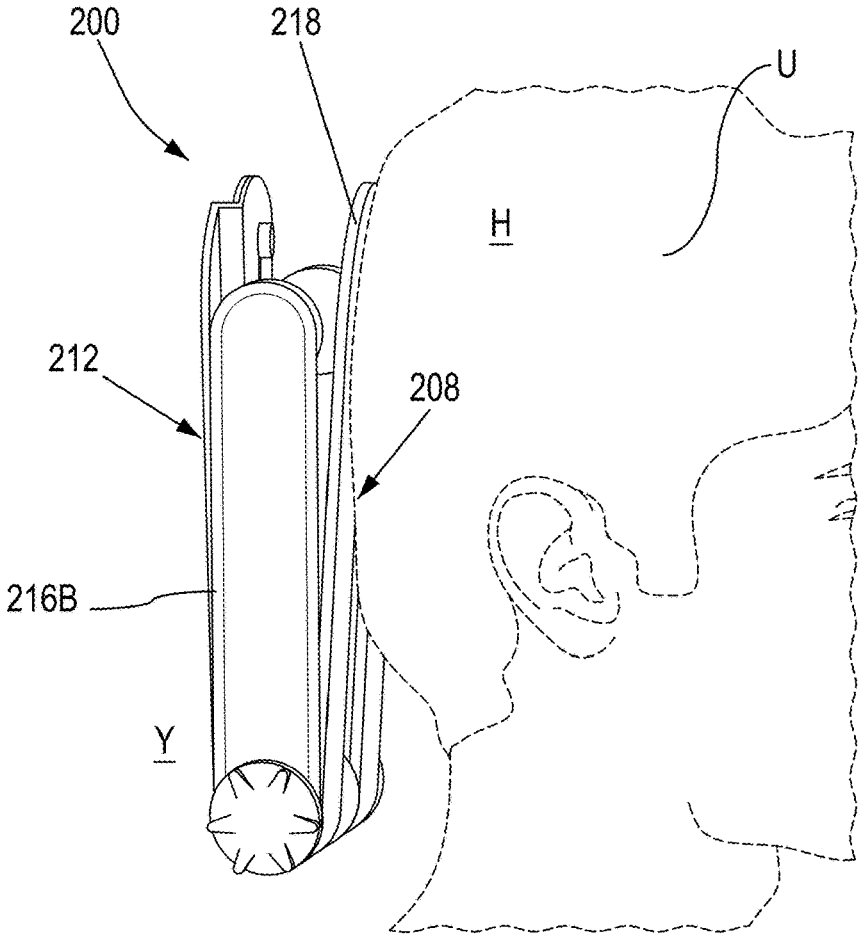
FIG. 22 is a lateral perspective view of the device of FIG. 15 mounted to a vertical surface and in use in accordance with a non-restrictive illustrative embodiment of the present disclosure.
Figure 23:
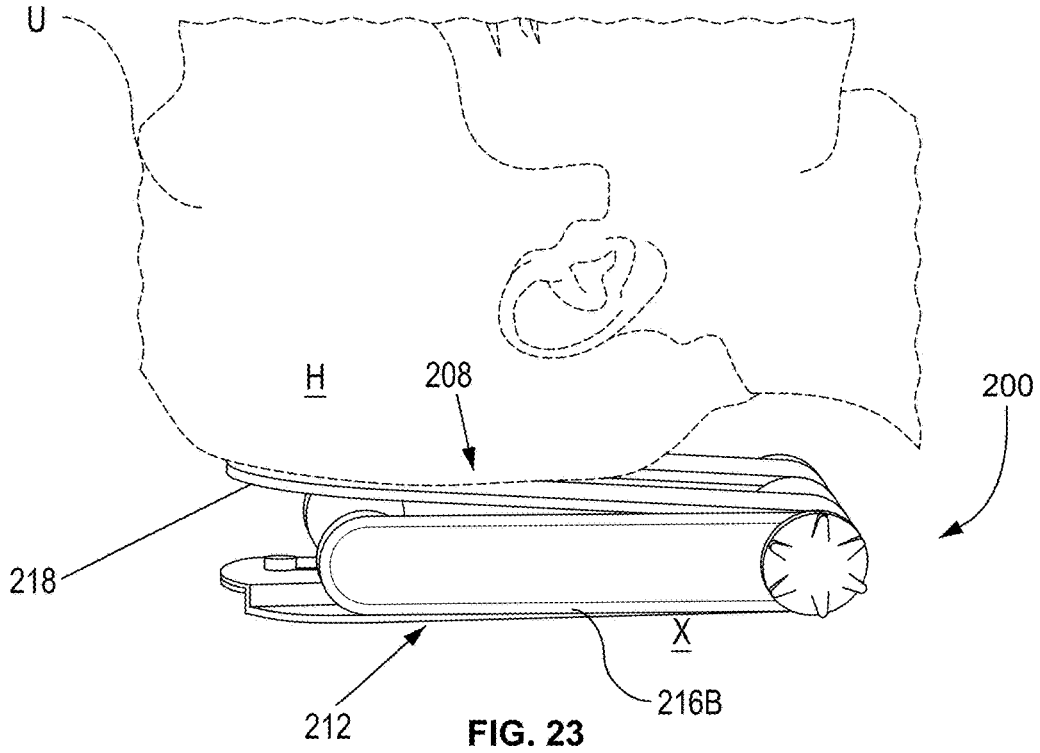
FIG. 23 is a lateral perspective view of the device of FIG. 15 mounted to a horizontal surface and in use in accordance with a non-restrictive illustrative embodiment of the present disclosure.

The base member 204 includes a central portion 226 and lateral portions 228A and 228B flanking the central portion 226. The central portion 226 inwardly protrudes at the inner side 214 between the lateral positions 228A and 228B forming an opposite recessed channel 230 at the surface engaging side 212 between the lateral portions 228A and 228B. The central portion 226 comprises aligned upper, median and lower sockets 232A, 232B and 232C respectively. A resistance element 40 is positioned within the upper socket 220A. The upper socket 232A and the resistance element 40 form a resistance assembly. Thus, and as shown in FIGS. 18, 22 and 23, during neck exercises discussed herein, the user U pushes against the movable member 202 with their head causing the protrusion 220 to push against the resistance element 40 thus providing the resistance pressure to the exercise. Other resistance 40 elements or varying degrees of resistance are positioned in the medial and lower sockets 232B and 232C when not in use. The space 224 in the movable member 202 provides a clearance for the coupled resistance elements and sockets 232B and 232C when moving the movable member 202 towards the base member 204 during the neck exercises provided herein.

The channel 230 provides for inserting a wall mounting element 234 therein. In this example, the wall mounting element 234 is a padding plate. An aperture 235 is provided through the central portion 226 for receiving a tab 236 therethrough extending from the padding plate 234 removably locking the plate 234 to the base member 204.

Figure 19:
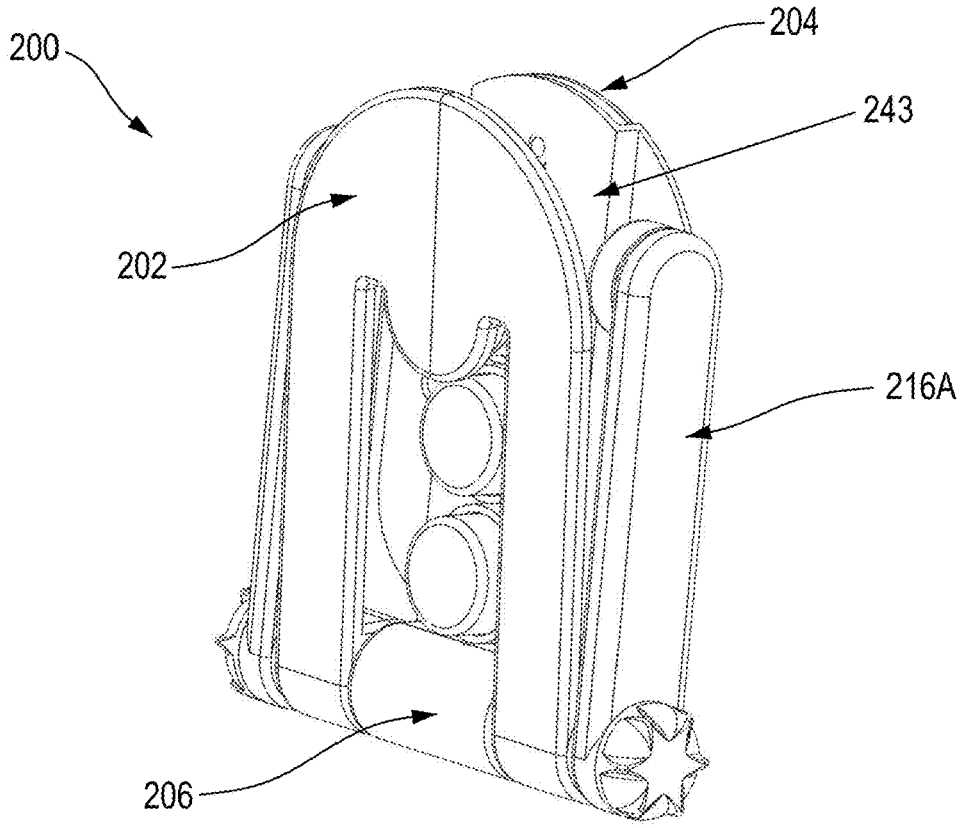
FIG. 19 is another second lateral and front side perspective view of the device of FIG. 15.
Figure 20:
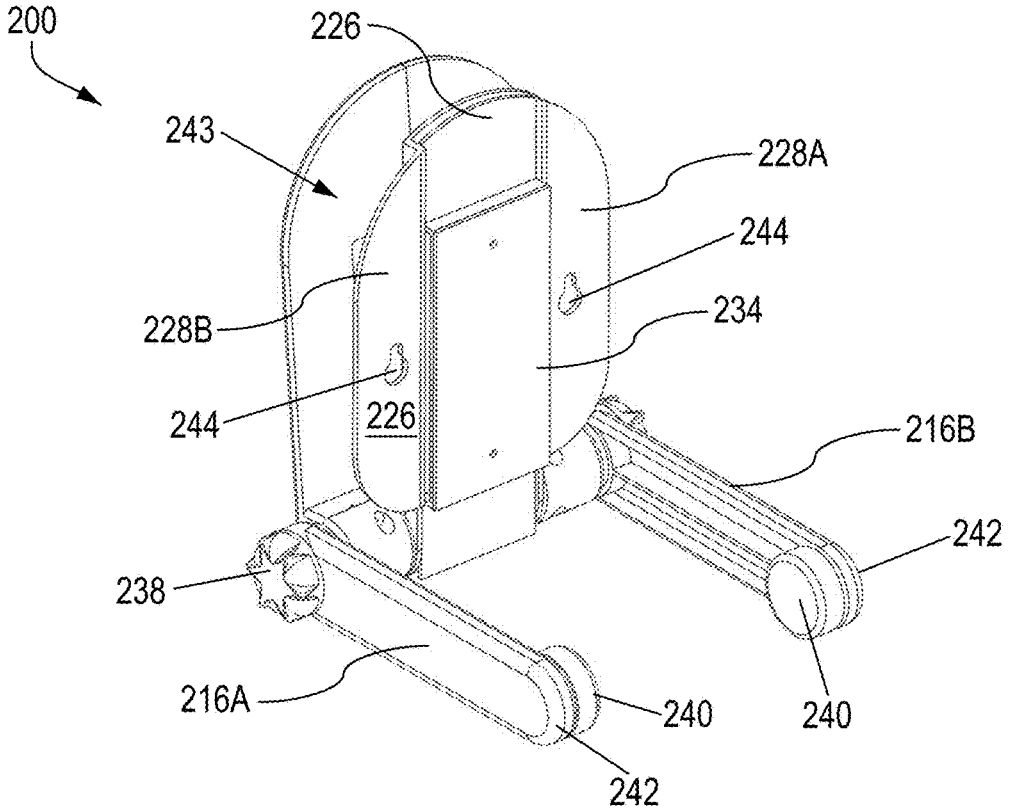
FIG. 20 is a first lateral side and rear side perspective view of the device of FIG. 15.

The installation arms 216A and 216B are pivotally mounted to the shaft 206. Each installation arm 216A and 216B is pivotally mounted at their respective proximal end 238 to a respective longitudinal end 239 of the shaft 206. Each installation arm 216A and 216B includes an inward hook element 240 at their respective distal ends 242 which is a protective element such as padding. The arms are pivotable between a folded position such as shown in FIGS. 19, 22 and 23 and an unfolded or deployed position as shown in FIGS. 15-18, and 20-21. When the arms 218A and 216B are in the folded position, the hook elements 240 are positioned in the gap 243 formed between the movable member 202 and the base member 204 providing clearance thereto.

The lateral portions 228A and 228B include respective apertures 244 for receiving mounting elements therethrough to be mounted to a surface. The rear side 212 of the base element 204 can receive adhesive material along the lateral portions 228A and 2288 or the plate 234.

Figure 21:
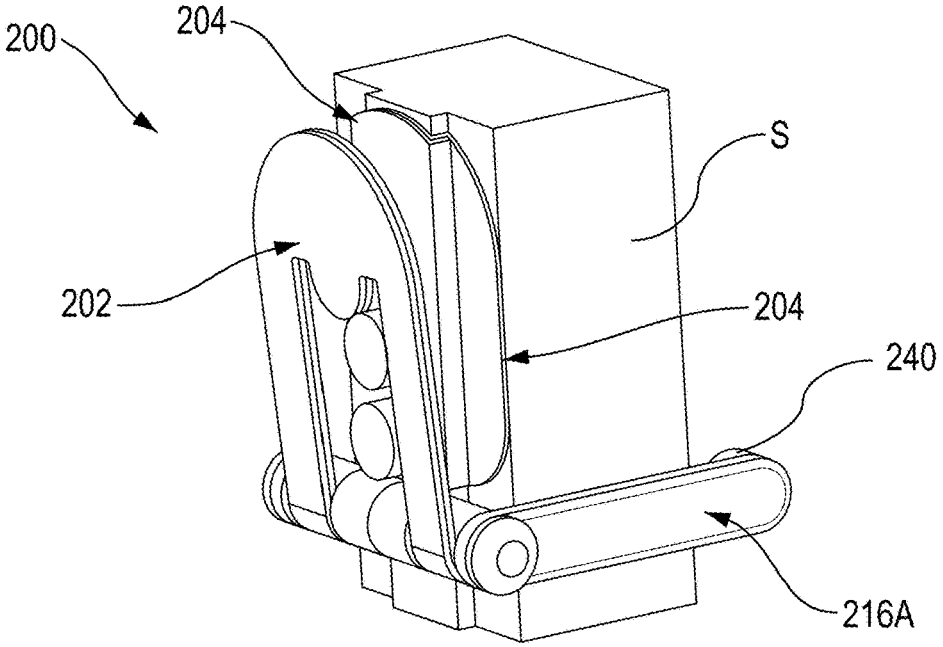
FIG. 21 is second lateral side and front side perspective view of the device of FIG. 15 mounted to a support.

The arms 216A and 216B allow the 200 device to be mounted to a structure S as shown in FIG. 21. The arms 216A and 216B clamp the structure S therebetween.

As shown in FIGS. 22 and 22, the user U mounts the device 200 to a vertical Y or horizontal surface X in order to engage with their head the on the user engaging side 208 and particularly the top plate 218 so as to push against the resistance of the resistance member 40 in socket 232A with the protrusion 220 in order to effectuate the exercises provided herein.

Figure 24:
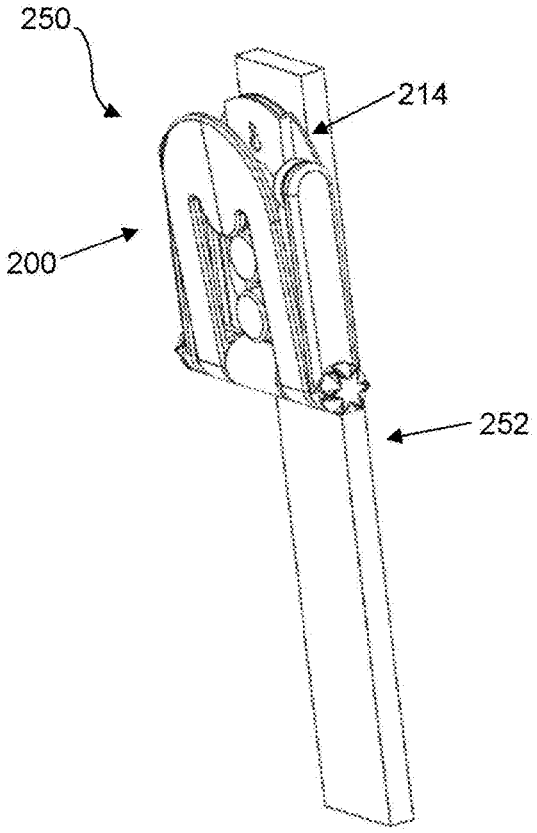
FIG. 24 is a perspective view of a chair mountable pressure device for neck exercising comprising the device of FIGS. 15-22 in accordance with a non-restrictive illustrative embodiment of the present disclosure.
Figure 25:
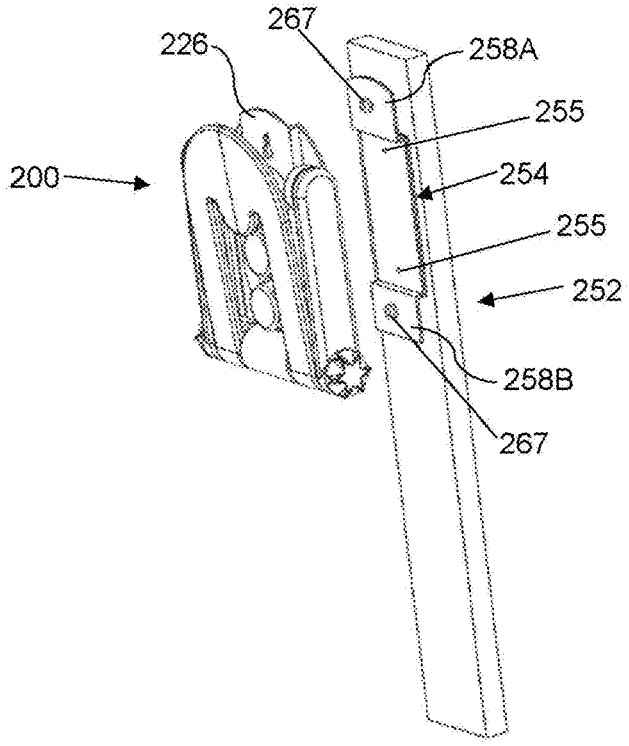
FIG. 25 is an exploded perspective view of the device of FIG. 23.
Figure 26:
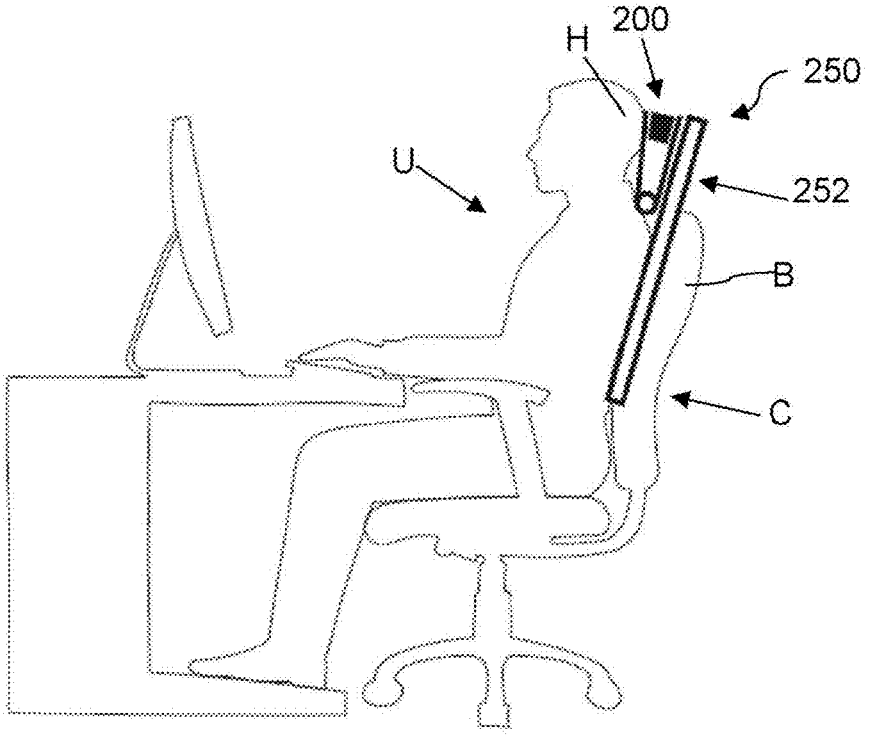
FIG. 26 is a schematic lateral side view of the device of FIG. 23 mounted to a chair and in use in accordance with a non-restrictive illustrative embodiment of the present disclosure.
Figure 27:
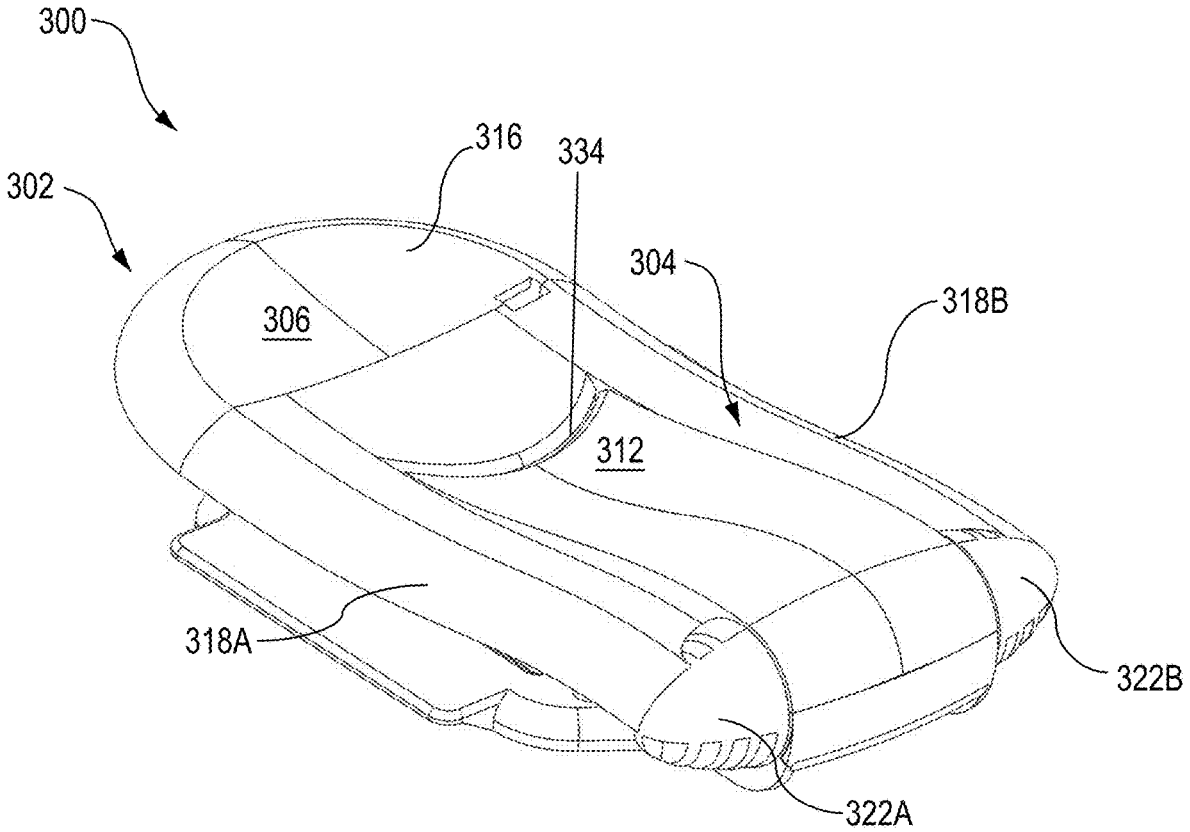
FIG. 27 is a top and side perspective view of a head pressure-resistant device for neck exercises in accordance with a further non-restrictive illustrative embodiment of the present disclosure.

Turning now to FIGS. 24 to 26, there is shown an exercise device 250 used in neck therapeutic exercises. Device 250 comprises device 200 mounted to a support 252. The support 252 comprises a longitudinal member, and the device 200 is mounted thereto at the surface mounting side 214 thereof. More particularly, a connecting panel 254 is fastened (via fasteners 255) on the support 252. The panel includes top and bottom forwardly protruding ends 258A and 258B positioned in the channel 230 to be mounted to the central portion 226 via fasteners 267.

A user U can mount the support 252 against the backrest B their chair C and thus use the device 250 as shown in FIG. 26 with the head H of the user U engaging the user engaging side 208 while seated.

Turning now to FIGS. 27 to 34 there is shown an exercise device 300 used in neck therapeutic exercises as provided herein. The device 300 provides a resistance pressure against which the user performs the exercises. The device 300 is mounted to a surface such as a wall, floor, a door jam, a support column, and the like and as will be further explained below.

Device 300 comprises a movable member or body 302 pivotally mounted to a base member or body 304.

The movable member 302 defines a user engaging side 306 and an opposite inner side 308. The base member 304 defines a surface engaging side 310 and an opposite side 312.

The movable member 302 comprises top plate 316 having a circular configuration and a pair of spaced apart arms 318A and 318B extending therefrom. The top plate 316 is inwardly curved at the surface engaging side 310 to provide a more comfortable head engagement for the user. The arms 318A and 318B are spaced apart defining an opening 320 (see FIGS. 32 and 34) which provides space for the base member 304 therebetween when the device is in the closed or not-in-use position shown in FIG. 27. The arms 318A and 318B form cylindrical brackets 322A and 322B at their terminal ends which are pivotally mounted to base member 304 positioned therebetween.

Figure 29:
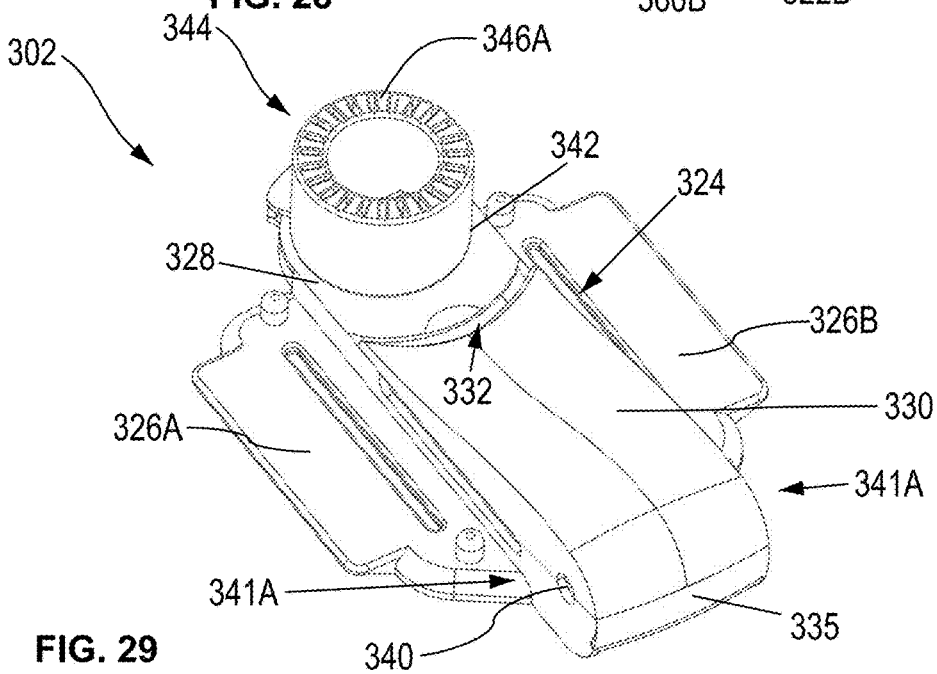
FIG. 29 is a top perspective view of a portion of the device of FIG. 27.
Figure 30:
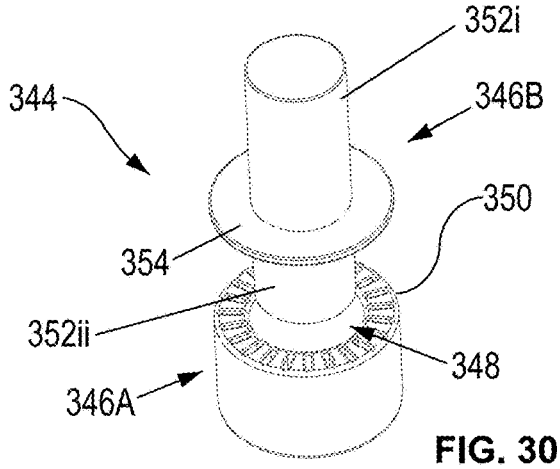
FIG. 30 is a perspective view of the resistance elements of the device of FIG. 27 in accordance with a non-restrictive illustrative embodiment of the present disclosure.
Figure 31:
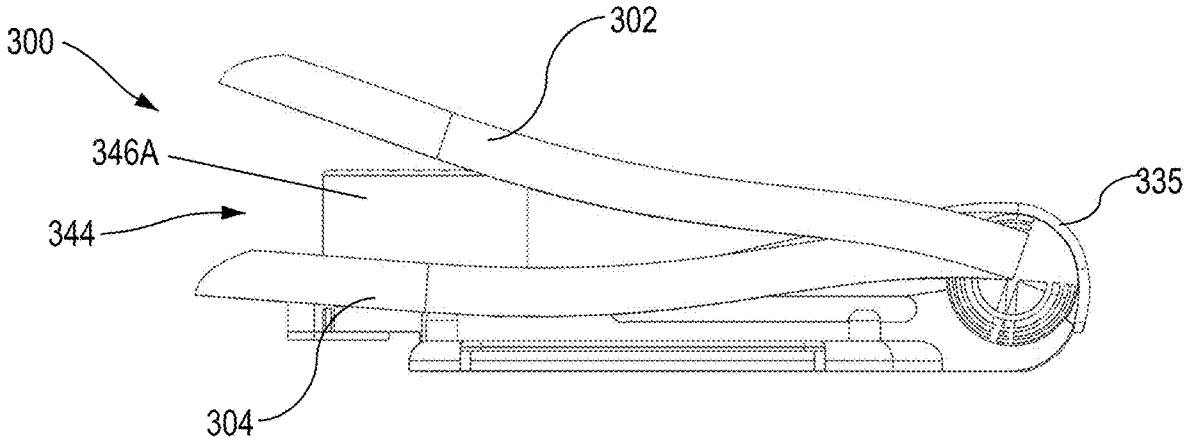
FIG. 31 is a side view of the device of FIG. 27 at one exercise starting position.
Figure 32:
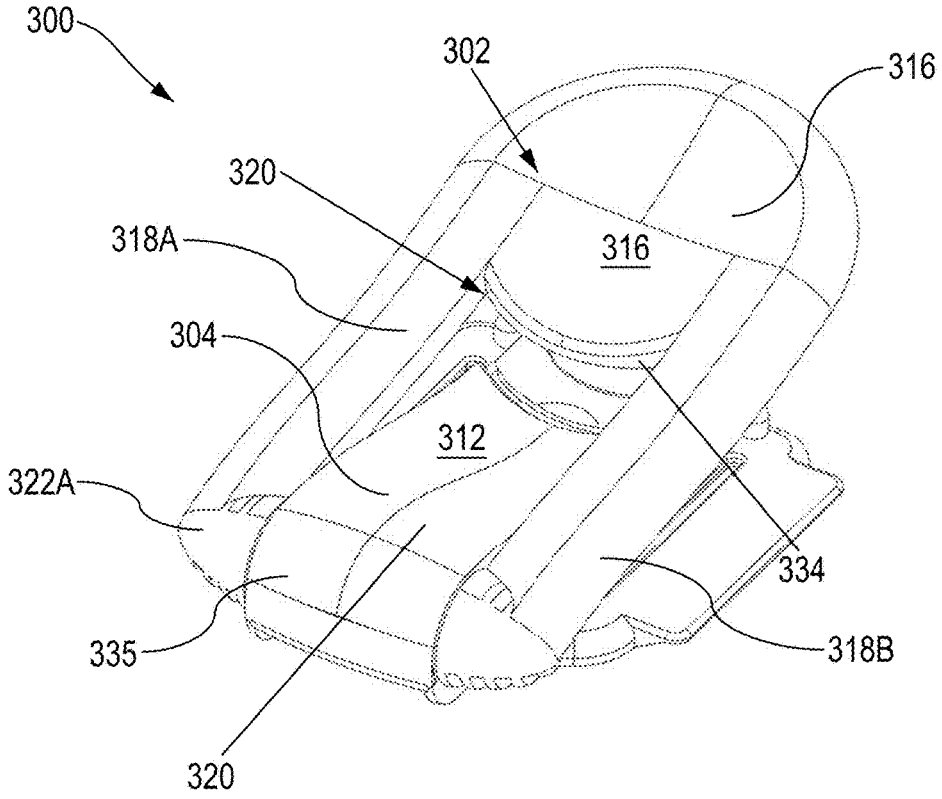
FIG. 32 is a front, top and side perspective view of the device of FIG. 27 at the exercise position of FIG. 31.
Figure 33:
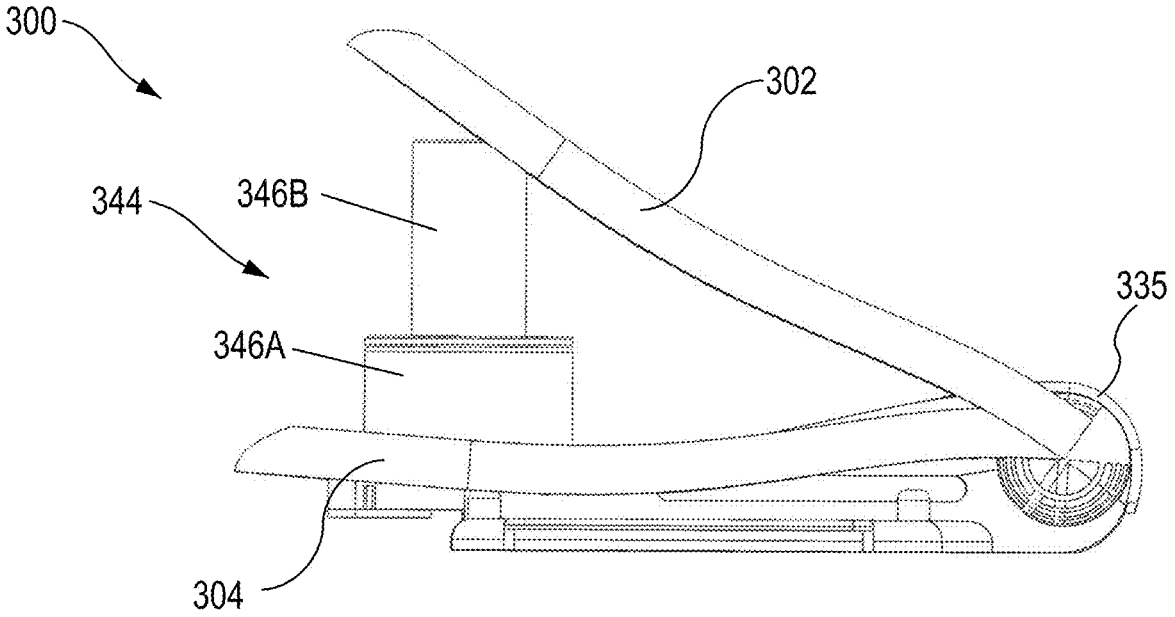
FIG. 33 is a side view of the device of FIG. 27 at another exercise starting position.
Figure 34:
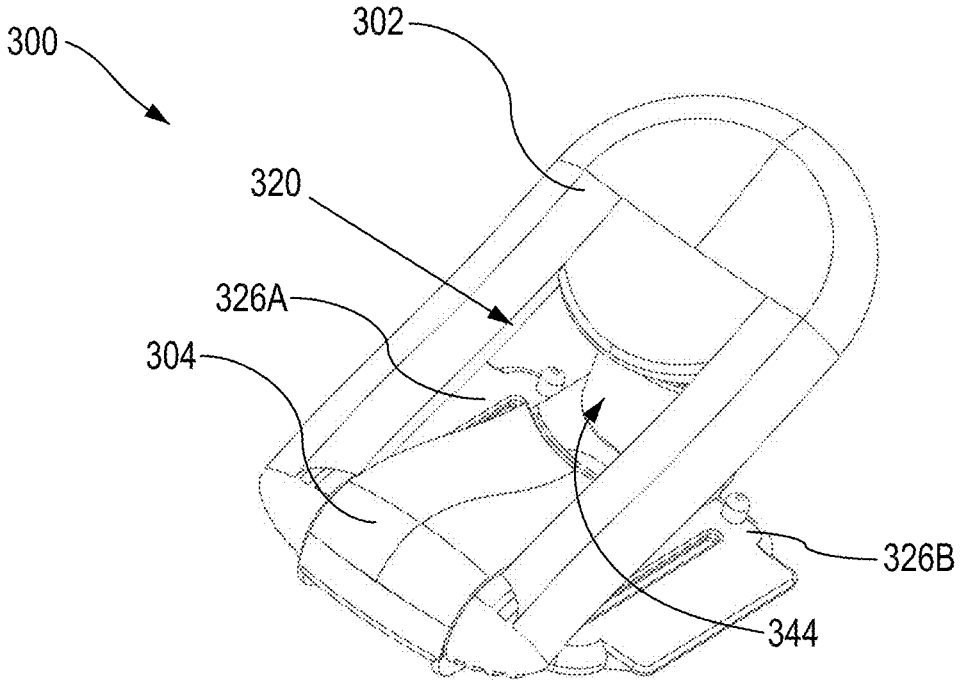
FIG. 34 is a front, top and side perspective view of the device of FIG. 27 at the exercise position of FIG. 33.
Figure 35:
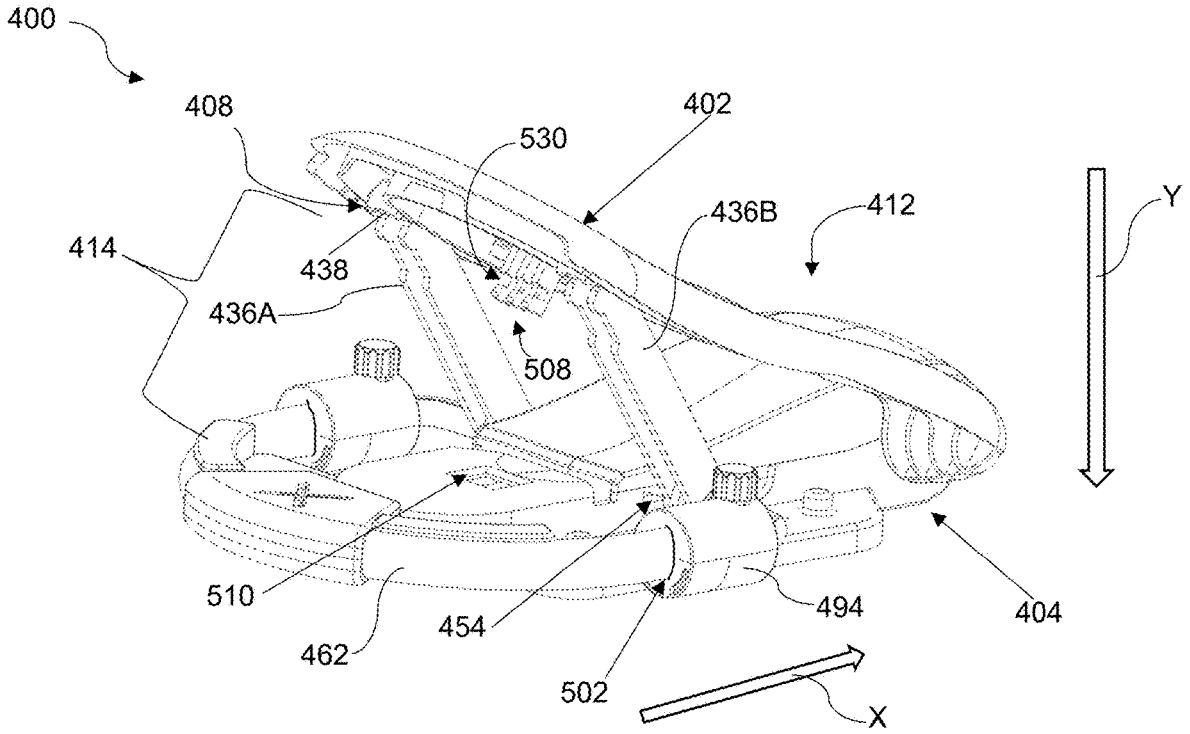
FIG. 35 is a perspective, rear, and side view of a head pressure-resistant device for neck exercises in an open position in accordance with yet further non-restrictive illustrative embodiment of the present disclosure.
Figure 36:
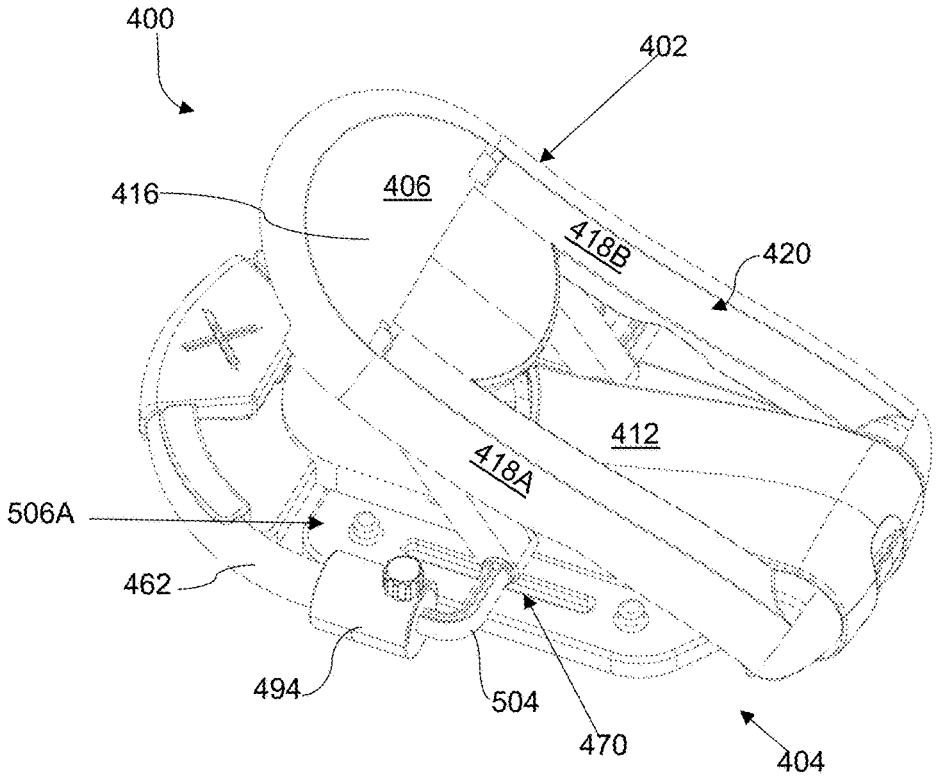
FIG. 36 is a perspective, top and front view the device of FIG. 35.
Figure 37:
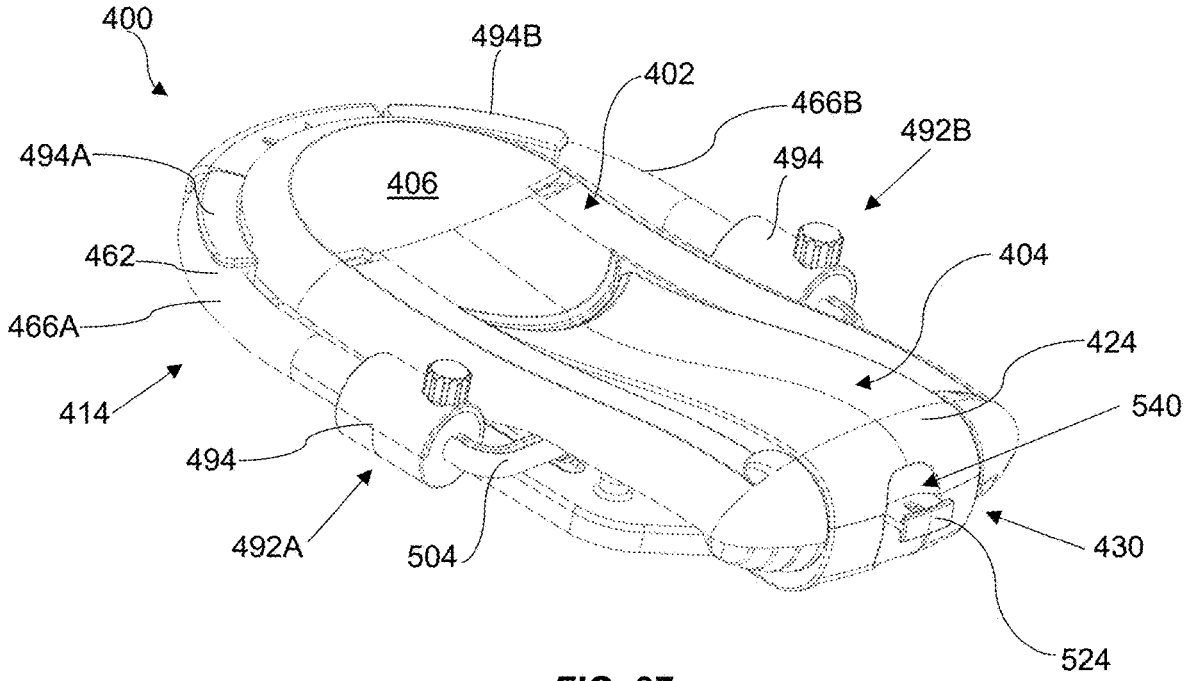
FIG. 37 is a perspective, top and front view the device of FIG. 35 in a closed position.

With particular reference to FIG. 29, the base member 304 includes a central portion 324 and lateral portions 326A and 326B flanking the central portion 324. The central portion 324 includes a top part 328 and a main part 330 connected to the lateral portions 326A and 326B and forming a gap 332 therebetween. When the device 300 is in the closed position, the lower lip 334 (see FIGS. 27 and 32) of the top plate 316 fits into the gap 332 and the opening 320 provides a space for the main part 330 to be exposed between arms 318A and 318B. In this way, when the device 300 is in the closed position of FIG. 27, side 306 of the movable member 302 and side 312 of the base member 304 are contiguous. The top part 328 slightly protrudes above the lateral portions 326A and 326B at side 312. The main part 330 increases in size as it extends from the gap 332 to its connecting terminal end 335 and in this way protrudes upwardly above the lateral portions 326A and 326B along an increasing curve from the gap 332 to the end 335 forming side walls respectively adjacent the lateral portions 326A and 326B. In this way, when the device 300 is in the closed position of FIG. 27, the arms 318A and 318B. The base member 302 thus provides rest spaces 326A and 326B for arms 318A and 318B. The terminal end 334335 includes apertures 340 at its respective lateral sides 341A, 341B for receiving respective pivot shafts therein mounted to brackets 322A and 322B, respectively and thus providing for the movable member 306 to pivot about the terminal end 335.

The top part 328 includes a pocket 342 at side 306 for receiving a resistance element 344 for being engaged by the inner side 308 of the top plate 316 during exercises. The pocket 342 and the resistance element form a resistance assembly.

In an embodiment, the resistance element 344 comprises first and second bodies 346A and 346B. The first body 346A comprises a compression ring forming a receiving hole 348 circumscribed by a rim 350. The second body 346B comprises spring foam having a cylindrical body 352 with a collar 354 extending therefrom defining a relatively longer top body section 352*i* above collar 354 and a relatively shorter bottom body section 352*ii* below the collar 354. The second body 346B is selectively mountable to the first body 346B by fitting the bottom body section 352*ii* within the hole 348 with the collar 354 resting on the rim 350 and the top body section 352*i* upwardly extending therefrom. Accordingly, the resistance element 344 is selectively modifiable to adjust the height thereof, the single first body 346A provides a first height and the combined first and second bodies 346A and 346B provide a second height that is greater than the first height. Various second bodies of various heights can be provided to further modulate the starting position of the movable member 302 on the resistance element 344. Indeed, various of second bodies of similar or varying heights can be provided with varying degrees of resistance to modulate the level of resistance for the neck exercises as provided herein. Moreover, the single first body 346Ai may be replaced by another first body of similar height or different height with similar or different degrees of resistance. Various configurations of single body resistance elements or linearly combined resistance multi-body resistance elements (two or more bodies) can be contemplated within the scope of the present disclosure to modulate the height and/or resistance of the resistance element 344.

Figure 28:
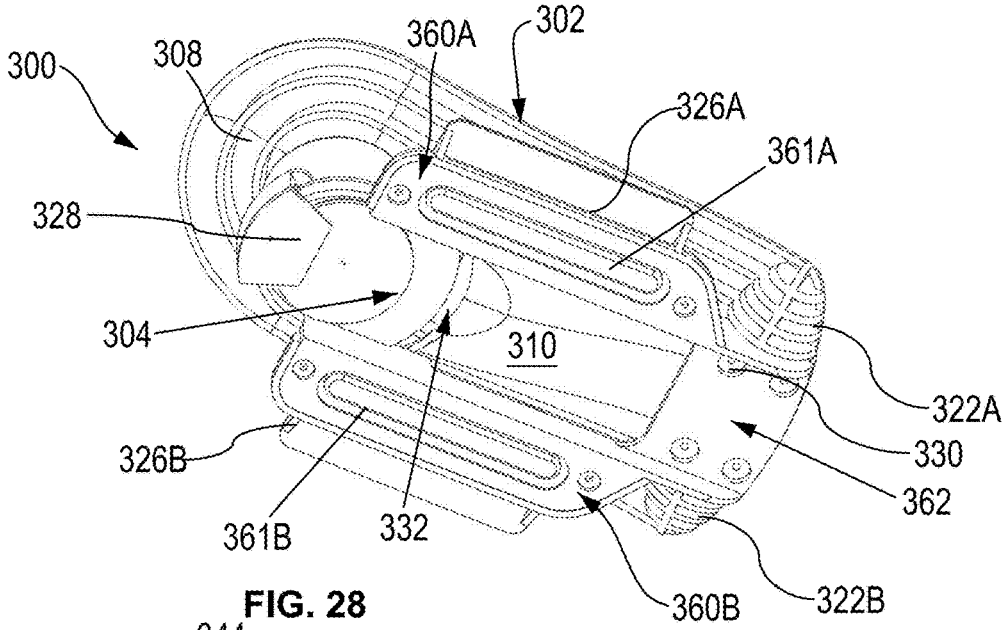
FIG. 28 is a bottom perspective view of the device of FIG. 27.

With reference to FIGS. 28 and 29, the lateral portions 326A and 326B define respective undersurfaces 360A and 360B thereof at the surface engaging side 310 of the base 304. These undersurfaces 360A, 360B are mountable to a surface. In an embodiment, the undersurfaces 360A, 360B define longitudinal areas 361A, 361B and for receiving adhesive pads or other elements to be mounted to a surface as can be contemplated by the skilled artisan. The undersurfaces 360A and 360B laterally flank a channel 362 formed by the top part 328 and the main part 330 of the base 304 being recessed at the surface engaging side 310 relative to undersurfaces 360A and 360B. Channel 362 can conveniently be fitted over a door jam.

Turning now to FIGS. 35 to 41 there is shown an exercise device 400 used in neck therapeutic exercises as provided herein. The device 400 provides a resistance pressure against which the user performs the exercises. The device 400 is mounted to a surface such as a wall, floor, a door jam, a support column, and the like and as will be further explained below.

Device 400 comprises a movable member or body 402 pivotally mounted to a base member or body 404.

Figure 1:
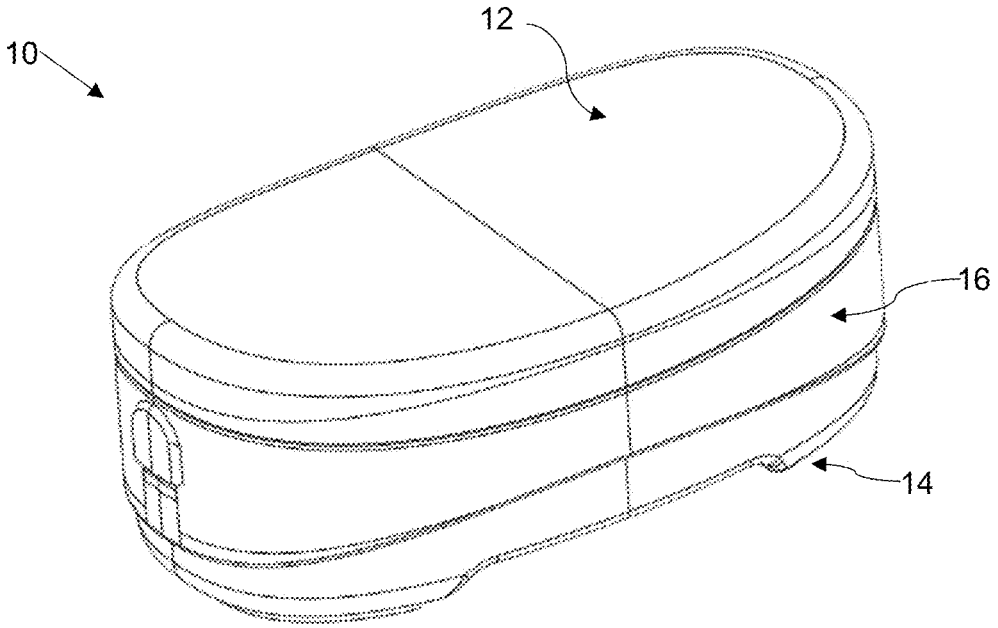
FIG. 1 is a perspective view of a head pressure-resistant device for neck exercises in accordance with a non-restrictive illustrative embodiment of the present disclosure.
Figure 2:
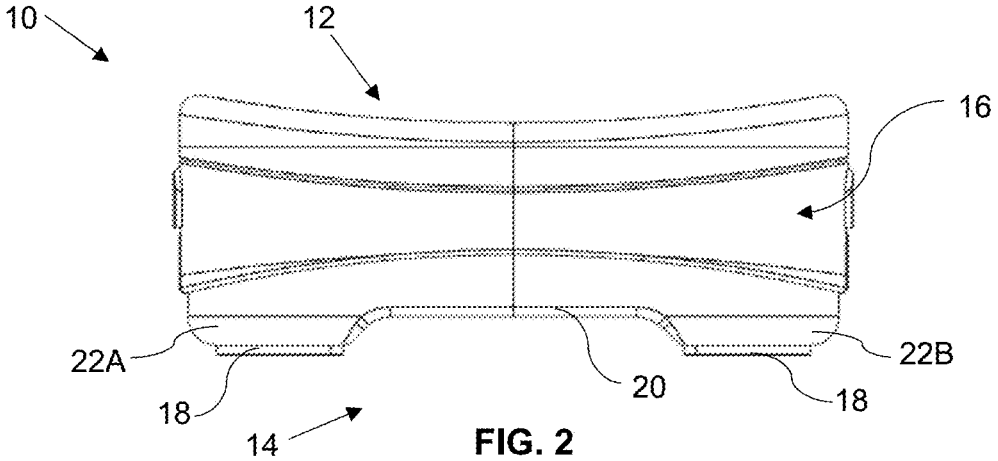
FIG. 2 is a lateral view of the device of FIG. 1.
Figure 3:
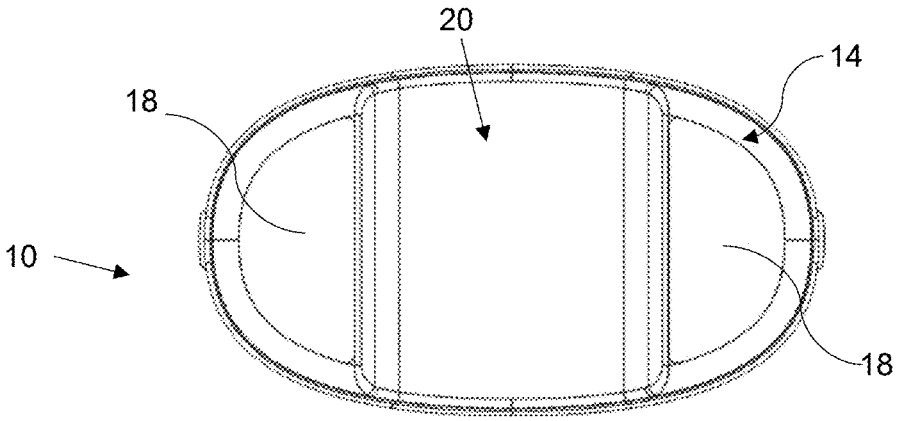
FIG. 3 is a rear view of the device of FIG. 1.

The movable member 402 defines a user engaging side 406 (see FIGS. 36 and 37) and an opposite inner side 408 (see FIG. 1). The base member 404 defines a surface engaging side 410 (see FIG. 38) and an opposite side 412 (see FIGS. 35 and 36). Sides 408 and 412 interface with another with the movable member 402 being movable towards the base member 404 thus bringing side 408 closer to side 412. The movable member 402 is pivotally mounted to the base member 404 and is movable between an open (expanded or unfolded) position shown in FIGS. 35 and 36 to a closed (or folded) position shown in FIG. 37. A resistance assembly 414 provides resistance against this movement of the movable member 402 towards the base member 404 (from the open to the closed positions). The resistance assembly 414 is mounted to the inner side 408 of the movable member 402 and the base member 404 as will be further described below.

The movable member 402 comprises top plate 416 having a circular configuration and a pair of spaced apart arms 418A and 418B extending therefrom. The top plate 416 is inwardly curved at the surface engaging side 406 to provide a more comfortable head engagement for the user. The arms 418A and 418B are spaced apart defining an opening 420 which provides space for the base member 404 therebetween when the device 400 is in the closed or not-in-use position.

Figure 39:
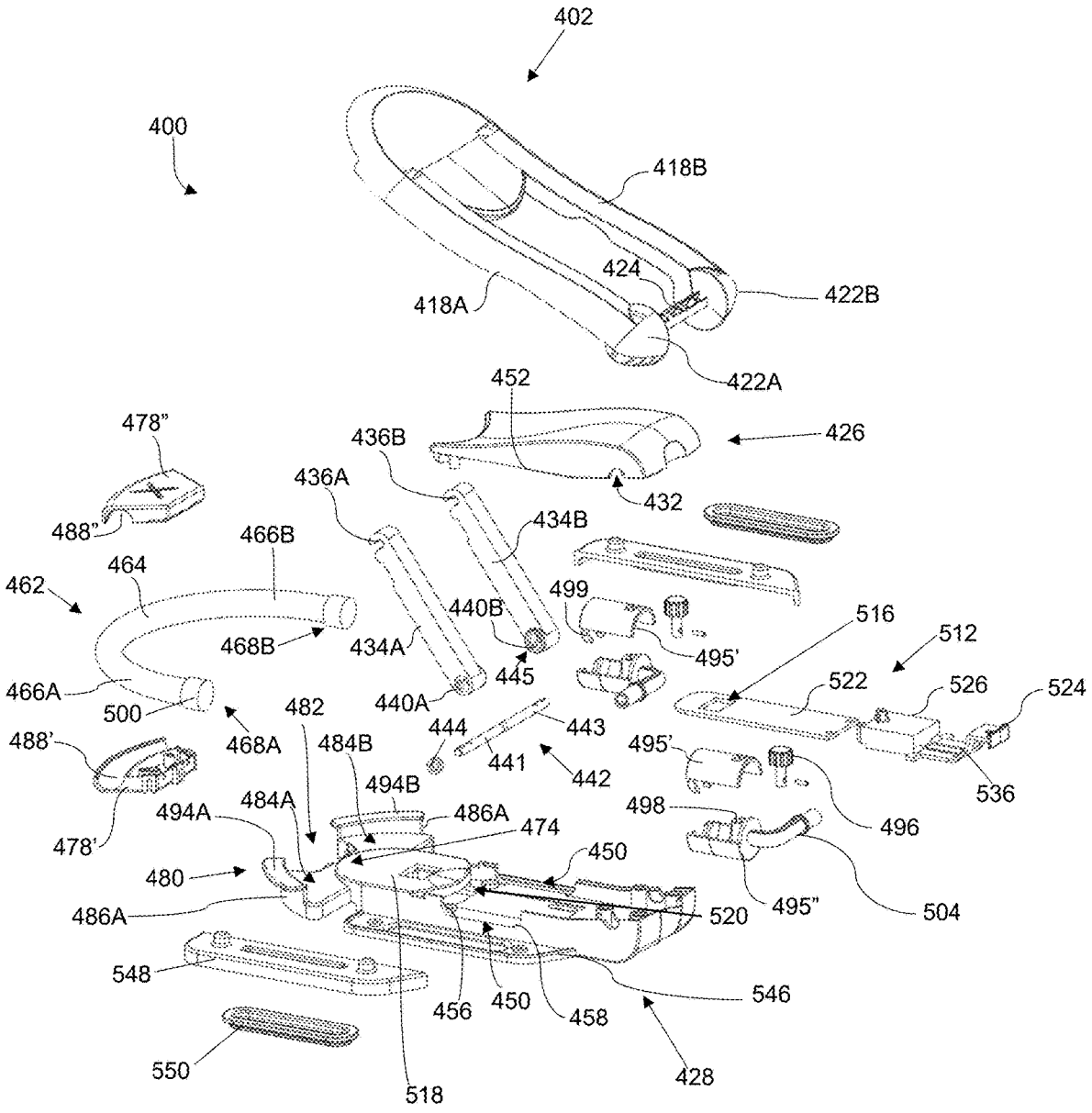
FIG. 39 is an exploded perspective view of the device of FIG. 35.

Turning now to FIG. 39, the arms 418A and 418B define cylindrical clamp ends 422A and 422B respectively with a pivot rod 424 extending therebetween and rotationally fitted between top and bottom sheath parts 426 and 428, respectively, of the base member 404 at the rear end 430 (see FIG. 37) thereof. Side openings 432 provide a space for the rod 424 outwardly protrude from. Thus, the top plate member 402 is pivotable about end 430 of the base member 404.

With reference to FIGS. 34, 39, 40 and 41, the resistance assembly 414 comprises a rigid structure movably mounted to the movable member 402 and to the base member 404 and interposed therebetween, the rigid structure is moved in the downward direction (see arrow Y in FIG. 35) and this movement is resisted to by a resistance element 462 mounted to the rigid structure as will be further discussed herein. In an embodiment and as shown in the Figures, the rigid structure comprises a pair of arms 434A and 434B pivotally mounted to the inner side 408 of the movable member 402. The arms 434A and 43B have respective hooks 436A and 436B at their top ends which are pivotally mounted on top rods 438 (see FIG. 35) of the inner side 408. The arms 434A and 434B have respective sockets 440A and 440B at their bottom ends for being pivotally mounted to a bottom adjustable rod 442 formed of two telescoping rod parts 441 and 443 to adjust the length thereof. The rod 442 extends between the sockets 440A and 440B. A roller 444 is rollingly mounted to the bottom rod 442 for rollingly engaging a floor surface 446 defines the inner side 448 of the bottom sheath part 428 of the base member 404. Cut-outs 450 are provided at the lateral sides 451 of the bottom sheath part 428 to allow a space for the ends of the bottom rod 442 to protrude outwardly from and to be connected to the inner sides 445 of the sockets 440A and 440B. When the top sheath part 426 is snapped onto the bottom sheath part 428, the cut-outs 450 with the bottom edge 452 of the top sheath part 426 provide a longitudinal opening 454 defining front and rear curved walls 456 and 458 that are engaged by the rod 442 during rolling movement. Indeed, the rod 442 via the roller 444 rolls along the floor surface 446 between the curved walls 456 and 458 along a length of the base member 404 provided by the opening 454.

Therefore, when the movable member 402 is moved towards the base member 404, the bottom sockets 440A and 4408 move inwardly towards wall 458 as the rod 442 and roller 444 roll on the surface 446. This inward movement of the bottom sockets 440A and 440B is resisted or dampened by a resistance structure 460.

The resistance structure 460 comprises a resistance element 462 made of flexible, deformable and resilient material. The resistance element 462 is in operative connection with the bottom sockets 440A and 440B and provides resistance of a downward movement of the arms 434A and 434B when pressure is applied thereto via the movable member 402. The resistance element 462 is U-shaped like a horseshoe having a central portion 464 (see FIG. 39) anchored to the base member 404 and pair of arms 466A and 466B extending therefrom defining free ends 468A and 468B operatively connected to bottom sockets 440A and 440B respectively. A bottom arm assembly 470 is formed by rod 442 with roller 444 and the connection between rod 442 and sockets 440A and 440B. The operative connection between the free ends 468A and 468B provides for resisting the movement of the bottom arm assembly 470 along the longitudinal opening 454 from wall 456 to wall 458, as the resistance element 462 pulls assembly 470 towards wall 456 due to its resilience as arms 466A and 4668 are being flexed or stretched towards wall 458.

Therefore, pressure on the arms 434A and 434B from the movable member 402 causes the arms 434A and 434B to move downwardly as shown by arrow Y (see FIG. 35), thus the hooks pivot 436A and 436B pivot about the top rods 438 and the sockets 440A and 440B pivot about the bottom rod 442 pushing, the downward movement of the arms 434A and 434B pushes the rod 442 inwardly as shown by arrow X (see FIG. 35) and thus the rod 442 pushes the roller 444 to roll along the surface 446 as the resistance element 462 resists the foregoing movement represented by arrow X causing the arms 434A and 434B to correspondingly resist the downward movement represented by arrow Y and thus resist the pressure of movable member 402 initiated by the chin tuck exercise as discussed herein.

With reference to FIGS. 35 to 41, the resistance structure 460 further comprises a support structure 472 for receiving the resistance element 462. The support structure 472 extends from the front end 474 of the bottom sheath part 428. The support structure 472 comprises a central body 476 with bottom and top clips 478' and 478" for snapping the central portion 464 of the resistance element 462 therebetween. The support structure 472 comprises main part 480 defining a recess 482 for receiving the bottom clip 478", and a pair of wings 484A and 484B are defined at each side of the recess 482 and define respective outer curved walls 486A and 486B. The bottom clip 478 defines a semi-circular longitudinal cavity 488' for receiving the resistance element central portion 464 therein with the resistance element arms 466A and 466B extending therefrom being positioned along the outer walls 486A and 486B. The top clip 478" also includes a semi-circular longitudinal cavity 488" for receiving the central portion 464 therein when the top clip 478" is snap fitted onto the bottom clip 478' sandwiching the central portion 464 therebetween. The resistance element arms 466A and 466B extend from the side openings 490 (see FIG. 40) defined by the mated semi-circular cavities 488' and 488" along the curved walls 486A and 486B towards respective connectors 492A and 4928 anchoring their ends 468A and 468B to the bottom arm assembly 470. The curved walls 486A and 486B include respective top shoulders 494A and 494B for maintaining the resistance element arms 466A and 466B in place along the walls 486A and 486B avoiding that they slide off in the upward direction to pressure thereto during movement of the bottom arm assembly 470 as explained above.

Each connector 492A and 492B comprises a barrel-like housing 494 formed by a pair of adjoining top and bottom halves 495' and 495" which are fastened together a tightening screw 496 through a hole 497 in the top half 495' and an threaded aperture 498 in the bottom half 495". The top half 495' also includes flexible clips 499 (see FIG. 39) that engage for snap connecting to the bottom half 495". In an embodiment, the top and bottom halves 495' and 495" are hinged together. Each resilient element end 468A and 468B defines a large collar 500 (see FIGS. 39 and 41) that is securely fitted within the housing 494 which provides a front hole 502 (see FIG. 35) for the arms 466A and 466B to be positioned thereto and also includes rear elbow connecting pipes 504 for securely receiving the longitudinal ends of the bottom rod 442 therein.

Therefore, the central portion 464 of the resistance element 468462 is secured to the topfront end 474 of the base member 404 via the support structure 472, with the arms 464A466A and 464B466B extending about the base member 404 via the support structure 472 with the ends 468A and 468B secured to bottom arm assembly via the connectors 492A and 492B.

A clearance space 506 (see FIG. 36) is provided at each side of the base 404 by the support structure 472, the arms 466A and 466B and the connectors 492A and 492B for receiving the arms 434A and 434B and the lateral portions (i.e. arms 418A and 418B) therein when the movable member 402 is completely brought down in engagement with the base member 404.

When the movable member 402 is completely brought down in engagement with the base member 404, the two pieces can be locked together in a closed position via a locking mechanism as provided herein. The inner side 408 of the movable member 404 has teeth 508 (see FIG. 35) protruding therefrom, the base 404 provides a window 510 for the teeth 508 to be positioned therethrough when the device 400 is in the closed position.

With reference to FIGS. 38 to 41, a movable tongue 512 is slidably mounted to an underfloor 514 of the bottom sheath part 426, this movable tongue 512 defines the aforementioned surface 446. The movable tongue 512 defines a window 516 that matches window 512 and thus together provide a clearance space for the teeth 508. The bottom sheath 428 comprises a raised platform section 518 defining a gap for receiving the front part of the tongue 512 defining the window 516 in order to allow the window 510 to overly the window 516. The tongue 512 includes a main elongated body 522 (that defines surface 446), a rear tab 524 and core section 526 therebetween. A user pulls the tab 524 (see also FIG. 37) to slidably pull the tongue 512 outwardly from the base member 404 along the underfloor 512, thus moving the window 516 therewith which lockingly engages the teeth 508. More specifically the front inner edge 528 (see FIGS. 38 and 41) of the window 514 engages the nooks 530 (see FIGS. 35 and 38) formed in the teeth 508 for a locking fit therewith. Thus, the user pulls the tab 524 until the locking fit is complete. When the user wants to release the device from the locked position, the user simply pushes the tab 524 inwardly and the edge 520 disengages the nooks 530 allowing for the movable member 402 to be pushed away from the base member 404 via the force of the resistance assembly 414 as provided herein. The tab 524 slides between guides 534, the core section 526 abuts the guides 534 preventing the user from pulling the tongue 512 from being removed from the base member 404. The rear tab 524 also includes a vertical stopper wall 536 for engaging the inner side of a rear portion 538 (see FIG. 40) of the bottom sheath part 426 thus preventing the tab 524 from being completely pushed into the base member 404 and inaccessible. The top sheath part 424 a includes a dimple 540 (see FIG. 37) allowing the user to access the tab 524. The top sheath part 426 covers the tongue 512 along with the rod 442 and roller 444 when snap fitted onto the bottom sheath part 426 enclosing the foregoing within the base member 404.

Figure 38:
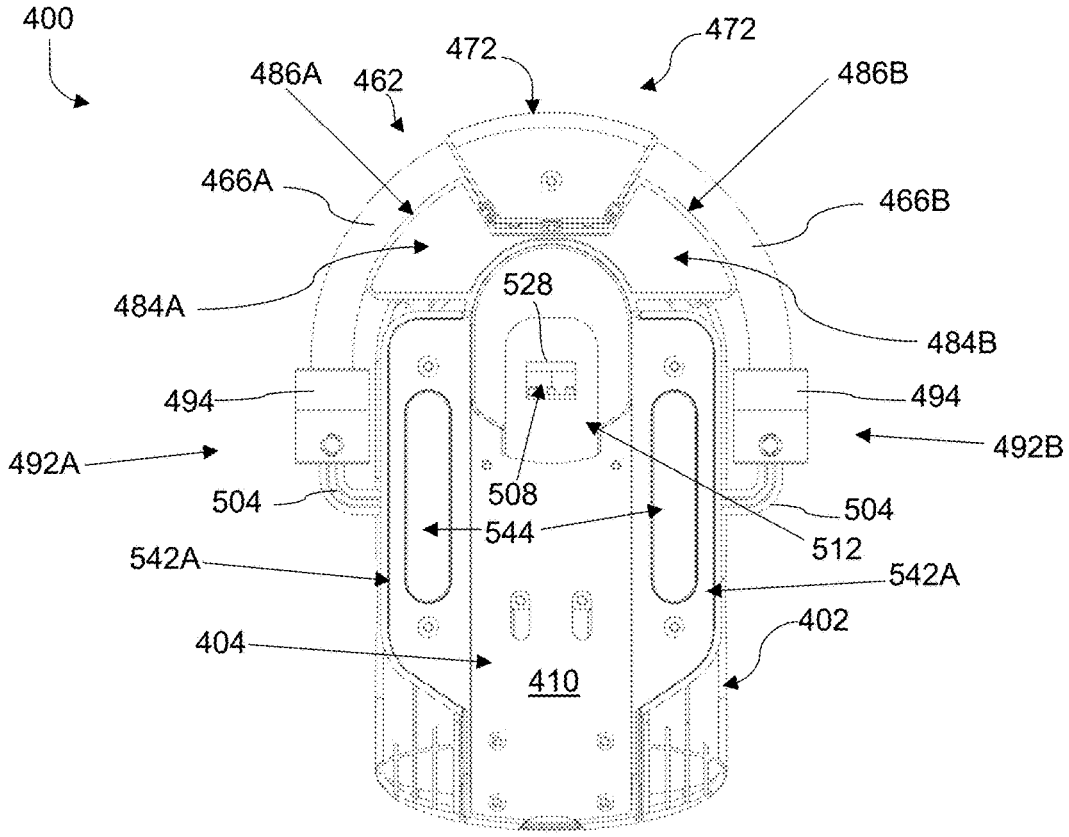
FIG. 38 is bottom view of the device of FIG. 37.
Figure 40:
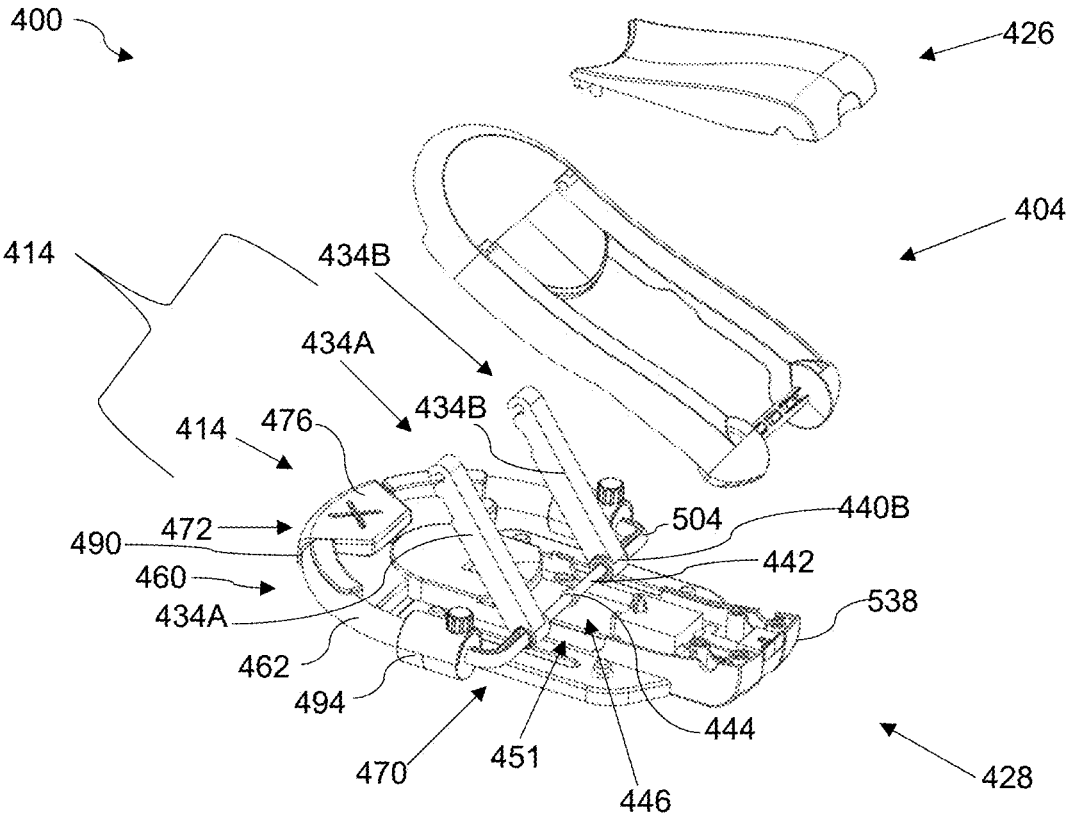
FIG. 40 is a partially disassembled perspective view of the device of FIG. 35.
Figure 41:
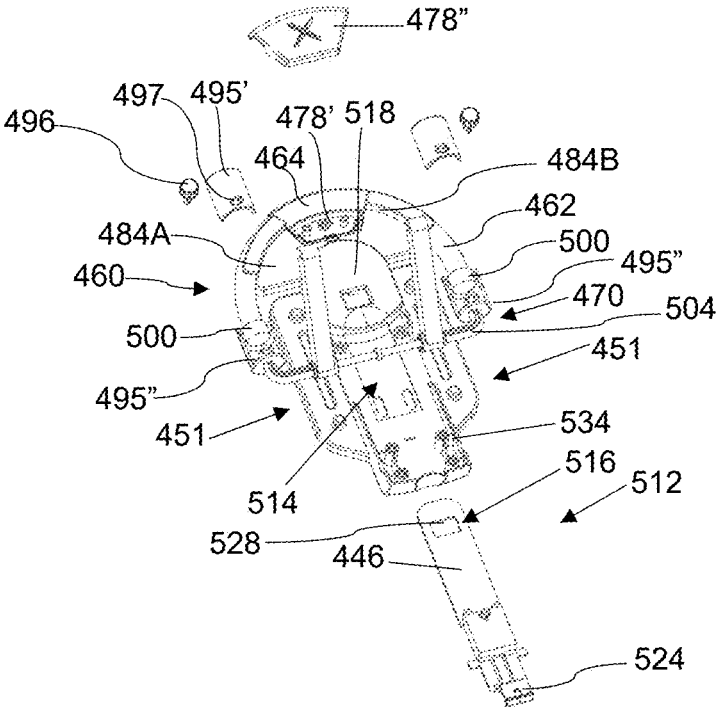
FIG. 41 is a partially disassembled perspective view of the base member of the device of FIG. 40.

With respect to FIGS. 38 and 40, lateral flap portions 542A and 542B extend from the base member 404 and provide stability to the device 400 as well as the possibility of fastening the device 400 to other surface via fasteners though the longitudinal apertures 544 of the portions 542A and 542B. The lateral flap portions 542A and 542B comprise respective base part 546, top parts 548 and inner members 550 circumscribing the apertures 544.

It is to be understood that the various features of device 100, 200, 300 and 400 as well these devices being mounted to supporting structures can be combined in a variety of suitable ways within the scope of the present disclosure.

Various embodiments provide various features within the scope of the present disclosure. For example, and without limitation thereto, device 100 has the resistance element 40 positioned at the center of the engagement surface or platform in this way, the user pushes directly against the resistance element, there is a more equal distribution or resistance throughout the platform being pushed. Moreover, there is no angle between the user engaging surface and the base providing for a straighter neck at the start of the movement and a comfortable subtle neck movement during the exercised.

For example and without limitation thereto, device 200 has only a small angle between the movable member and the base member and they are pivotally connected at a common end with the resistance element being positioned towards another mutual end thereof that is offset from the center of the user engaging side to provide a smaller angle between the movable member and base member as compared to having the resistance element positioned closer to the pivot point or at the center. Yet, the resistance element is not positioned too close to the mutual other end (i.e. the end opposite the pivot) in order to provide a more equal distribution of resistance along the user engaging surface (i.e. platform being pushed). The foregoing relatively small angle provides for a subtle neck movement as the neck need not be angled to engage the movable member.

For example, and without limitation thereto, device 300 has the resistance element positioned similarly to device 200, yet the angle between the movable member and the base can be selectively increased in order to provide for a greater range of movement to the neck as required.

Device 400, the pivotal movement of the arms between the movable member and the base provides for decreasing the height of the resistance assembly similarly to the other devices (10, 100, 200 and 300) in which the resistance element is directly pressed. In device 10, 100, 200 and 300, the resistance assembly comprises a receiving structure such as the sockets or pockets provided herein to receive the one or more resistance element, moreover in these examples it is the resistance element which provides the height of the resistance assembly and as such, the resistance element height is the resistance assembly height.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. A device for neck exercises comprising:

a base defining a surface engaging side and an opposite inner side;

a movable body defining a user engaging surface; and a resistance assembly comprising at least one resistance element comprising flexible and resilient material and a rigid structure comprising a pair of arms mounted at respective top ends thereof to the movable body and movably mounted at respective bottom ends thereof to the base, the bottom ends of the pair of arms being movable along a length of the base, the resistance element comprising a U-shaped configuration having a central portion thereof mounted to the base and free ends thereof operatively connected to the bottom ends of the pair of arms, wherein pressure by the head of a user against the user engaging surface imparts a movement to the movable body towards the base providing pressure of the movable body, the rigid structure thereby imparting a movement of the rigid structure towards the base, the resistance element resisting the movement of the bottom ends of the arms along the length of the base thereby resisting the movement of the rigid structure and the movable body towards the base.

2. A device according to claim 1, wherein the movable body is movably mounted to the base and wherein the movable body is movable from an open position to a closed position engaging the base member.

3. A device according to claim 2, wherein the movable body and the base comprises mutual locking elements for being locked in the closed position.

4. A device according to claim 1, further comprising additional resistance elements comprising respective levels of resistance thereby providing for selective modulation of the resistance against the movement of the movable body.

5. A device according to claim 1, wherein the resistance assembly comprises at least one receiving structures for receiving the free ends of the resistance element therein.

6. A device according to claim 1, further comprising one or more biasing elements mounted to the base and engaging the movable body for biasing the movable body away from the base.

7. A device according to claim 1, wherein the surface engaging side provides for being mounted to a surface.

8. A device according to claim 1, further comprising a supporting structure, the surface engaging side being mountable to the supporting structure.

9. A device for neck exercises comprising:

a base defining a surface engaging side and an opposite inner side;

a movable body defining a user engaging surface side; and a resistance assembly comprising at least one resistance element comprising flexible and resilient material and a rigid structure comprising a top portion thereof mounted to the movable body and a bottom portion thereof movably mounted to the base, the bottom portion of the rigid structure being movable along a length of the base, the resistance element comprising a portion thereof mounted to the base and a pair of end portions thereof operatively connected to the bottom portion of the rigid structure, wherein pressure by the head of a user against the user engaging surface imparts a movement to the movable body and the rigid structure towards the base, the resistance element resisting the movement of the bottom portion of the rigid structure along the length of the base thereby resisting the movement of the rigid structure and the movable body towards the base.

10. A device according to claim 9, wherein the rigid structure comprises a pair of arms movably mounted at a top end thereof, forming part of the top portion of the rigid structure, to the movable body and movably mounted at a bottom end thereof, forming part of the bottom portion of the rigid structure, to the base member, the bottom end of the pair of arms being movable along the length of the base member, wherein the resistance element is operatively connected to the bottom end of the pair of arms to resist the movement thereof along the length of the base member.

11. A device according to claim 9, wherein the movable body is movably mounted to the base member and wherein the movable body is movable from an open position to a closed position engaging the base member.

12. A device according to claim 11, wherein the movable body and the base comprise mutual locking elements for being locked in the closed position.

13. A device according to claim 9, further comprising additional resistance elements comprising respective levels of resistance thereby providing for selective modulation of the resistance against the movement of the movable body.

14. A device according to claim 9, wherein the resistance assembly comprises receiving structures for receiving the end portions of the resistance element therein.

15. A device according to claim 9, further comprising one or more biasing elements mounted to the base and engaging the movable body for biasing the movable body away from the base.

16. A device according to claim 9, wherein the surface engaging side provides for being mounted to a surface.

17. A device according to claim 9, further comprising a supporting structure, the surface engaging side being mountable to the supporting structure.

18. A device according to claim 9, wherein the resistance element comprises separate resistance bodies.

19. A device according to claim 9, wherein the resistance element comprises at least two portions thereof mounted to the base at least two portions thereof respectively operatively connected to the longitudinal structure.

20. A device for neck exercises comprising:

a base defining a surface engaging side and an opposite inner side;

a movable body defining a user engaging surface; and a resistance assembly comprising a longitudinal structure and at least one resistance element comprising flexible and resilient material, the longitudinal structure movably mounted to the base at a bottom part thereof to be movable along a length of the base and being mounted to the movable body at a top part thereof, the resistance element being mounted to the base and operatively connected to the bottom part of the longitudinal structure and flexibly and resiliently extending therebetween along a length of the base, wherein pressure by the head of a user against the user engaging surface imparts a movement to the movable body towards the base providing for moving the top part of the longitudinal structure towards the base and the bottom part of the longitudinal structure along the length of the base, the resistance element providing resistance against the movement of the bottom part of the longitudinal structure along the length of the base thereby resisting the movement of the movable body towards the base when pressured by the head of the user.

* * * * *